US009165753B2

(12) United States Patent
Loboda et al.

(10) Patent No.: US 9,165,753 B2
(45) Date of Patent: Oct. 20, 2015

(54) IONIZATION WITH FEMTOSECOND LASERS AT ELEVATED PRESSURE

(71) Applicants: DH Technologies Development Pte. Ltd., Singapore (SG); National Research Council of Canada, Ottawa (CA)

(72) Inventors: Alexandre V. Loboda, Thornhill (CA); Paul Corkum, Ottawa (CA); David Rayner, Ottawa (CA)

(73) Assignees: DH Technologies Development Pte. Ltd., Singapore (SG); National Research Council of Canada (CA)

( * ) Notice: Subject to any disclaimer, the term of this patent is extended or adjusted under 35 U.S.C. 154(b) by 0 days.

(21) Appl. No.: 14/368,686

(22) PCT Filed: Dec. 4, 2012

(86) PCT No.: PCT/IB2012/002586

§ 371 (c)(1),
(2) Date: Jun. 25, 2014

(87) PCT Pub. No.: WO2013/098610

PCT Pub. Date: Jul. 4, 2013

(65) Prior Publication Data

US 2015/0008313 A1 Jan. 8, 2015

Related U.S. Application Data

(60) Provisional application No. 61/581,136, filed on Dec. 29, 2011.

(51) Int. Cl.

| | |
|---|---|
| ***H01J 49/00*** | (2006.01) |
| ***H01J 49/14*** | (2006.01) |
| ***H01J 49/16*** | (2006.01) |
| ***H01J 49/04*** | (2006.01) |
| ***H01J 49/26*** | (2006.01) |

(52) U.S. Cl.

CPC ..... *H01J 49/14* (2013.01); *H01J 49/0031* (2013.01); *H01J 49/0422* (2013.01); *H01J 49/164* (2013.01); *H01J 49/26* (2013.01)

(58) Field of Classification Search

USPC ..... 250/281, 282, 286, 287, 288

See application file for complete search history.

(56) References Cited

U.S. PATENT DOCUMENTS

| | | | |
|---|---|---|---|
| 5,742,050 | A | 4/1998 | Amirav et al. |
| 2003/0052268 | A1 | 3/2003 | Doroshenko et al. |
| 2008/0067409 | A1 | 3/2008 | Corr et al. |
| 2009/0039245 | A1 | 2/2009 | Brown et al. |

FOREIGN PATENT DOCUMENTS

| | | | |
|---|---|---|---|
| JP | 2002-015699 | A | 1/2002 |

OTHER PUBLICATIONS

International Search Report from International Patent Application No. PCT/IB2012/002586, dated Apr. 29, 2013.

*Primary Examiner* — Nicole Ippolito
*Assistant Examiner* — Hanway Chang

(57) ABSTRACT

The present disclosure generally provides ionization methods and devices for use in mass spectrometry. In some embodiments, the ionization methods and devices employ short laser pulses (e.g., pulses having pulsewidths in a range of about 2 fs to about 1 ps) at a high intensity (e.g., an intensity in a range of about 1 TW/cm$^2$ to about 1000 TW/cm$^2$) to ionize an analyte an ambient pressure greater than about $10^{-5}$ Torr (e.g., an ambient pressure in a range of about 1 atmosphere to about 100 atmospheres).

20 Claims, 18 Drawing Sheets

IONIZATION WITH FEMTOSECOND LASERS AT ELEVATED PRESSURE

RELATED APPLICATION

This application claims the benefit and priority from U.S. Provisional Application Ser. No. 61/581,136, filed on Dec. 29, 2011, the entire contents of which are incorporated by reference herein.

FIELD

The present disclosure is generally directed to ionization methods and devices for use in mass spectrometry and ion mobility spectrometry.

BACKGROUND

A variety of ionization techniques are employed in mass spectrometry. Some examples of such ionization techniques include Electrospray Ionization (ESI), Matrix Assisted Laser Desorption/Ionization (MALDI), and Electron Impact (EI) ionization, among others. The known ionization methods can be characterized by their ionization efficiency, the tendency to cause fragmentation ("softness" of ionization) and the degree of their universality (their ability to ionize a wide range of compounds efficiently). The known ionization methods suffer from a number of shortcomings. For example, EI ionization, though universal, is not "soft" and has a relatively low efficiency. ESI is "soft" but it is not universal (e.g., it is not suitable for ionizing non-polar compounds). Accordingly, there is a need for enhanced ionization methods and devices, and for such methods and devices that can be utilized in a mass spectrometer.

SUMMARY

The following summary is intended to introduce the reader to this specification but not to define any invention. One or more inventions may reside in a combination or sub-combination of the system and/or device elements or the method steps described below or in other parts herein. The inventors do not waive or disclaim their rights to any invention or inventions disclosed in this specification merely by not describing such other invention or inventions in the claims.

In one aspect, in a mass spectrometer, a method for ionizing a sample is disclosed, which comprises irradiating a sample at an ambient pressure in a range of about $10^{-5}$ Torr to about $10^{5}$ Torr with one or more radiation pulses, e.g., laser pulses, having a pulsewidth in a range of about 2 femtoseconds to about 1 picosecond at a pulse power density (i.e., power density per pulse) sufficient to cause ionization of at least a portion of the sample. For example, in some embodiments, the pulse power density of the pulse(s) that cause ionization of the sample can be in a range of about 1 TW/cm$^2$ to about 1000 TW/cm$^2$. In some embodiments in which the sample is introduced via a carrier gas into a region in which it is exposed to the ionizing radiation, the power density of the pulses in that region can be any value up to the limit imposed by a pulse density that can cause breakdown (e.g., runaway ionization) of the carrier gas. For example, the pulse power density can have an upper limit of about 2 PW/cm$^2$. In some embodiments, the radiation pulse(s), e.g., the laser pulse(s), can be focused to obtain the required pulse power density.

In some embodiments, the ambient pressure at which the radiation pulses are applied to the sample can be in a range of about 1 atmosphere to about 100 atmospheres.

In some embodiments, the radiation pulses applied to the sample can have a pulsewidth in a range of about 30 fs to about 500 fs, e.g., in a range of about 50 fs to about 100 fs.

In some embodiments, a sample containing one or more analytes can be introduced into an ionization chamber and radiation pulses, e.g., laser pulses, having a pulsewidth in a range of about 2 fs to about 1 picosecond, and more typically, in a range of about 2 fs to about 500 fs, and having a power density per pulse in a range of about 1 TW/cm$^2$ to about 1000 TW/cm$^2$ can be focused onto the sample (or at least a portion thereof) to cause ionization thereof.

In some embodiments, a portion of ambient air can be ionized outside a mass spectrometer in proximity of a sampling aperture of the mass spectrometer by applying to the air radiation pulses, e.g., laser pulses, having the parameters discussed above, and the ionized air, or at least a portion thereof, can be drawn into the mass spectrometer for analysis. In some embodiments, such ionization and analysis of the air can be used for monitoring air quality. In some embodiments, a sample carried by a carrier gas can be ionized outside a mass spectrometer in proximity to a sampling aperture of the mass spectrometer by using one or more radiation pulses, e.g., laser pulses, having the above parameters. The ionized sample can be drawn into the mass spectrometer for analysis. By way of example, such ionization of a sample and its analysis can be employed in a system for breath test.

In some embodiments, a buffer gas can be employed to introduce the sample, which can be in a gaseous state, into the ionization chamber. In some embodiments, the buffer gas can have an ionization potential that is greater than the ionization potentials of one or more analytes present in the sample. By way of example, in some embodiments, the buffer gas can be a noble gas, such as helium.

In some embodiments, the radiation pulses applied to the sample can cause non-resonant ionization of one or more analytes in the sample. As such, the above method can be utilized for ionizing a wide range of compounds.

In some embodiments, the central wavelength of the radiation pulses can be in a range of about 200 nm to about 100 micrometers (microns). For example, the central wavelength of the radiation pulses can be in a range of about 600 nm to about 10 microns, or in a range of about 800 nm to about 3 microns.

A variety of repetition rates can be employed for applying the radiation pulses to the sample. By way of example, the repetition rate can be in a range of about 1 Hz to about 100 MHz.

In various embodiments, the ionized sample is introduced into a mass analyzer of a mass spectrometer for mass analysis. For example, in some embodiments, the sample ions can be introduced from an ionization chamber in which the ions are generated via exposure to short laser pulses into a mass spectrometer via a sampling aperture, e.g., a sampling cone, of the mass spectrometer.

In some embodiments, the laser pulses can be introduced into the ionization chamber in a direction substantially orthogonal to a longitudinal axis of the spectrometer. In such cases, the analyte molecules can be introduced into the ionization chamber in a variety of ways. For example, in some embodiments, the analyte molecules can be introduced into the ionization chamber in a direction substantially orthogonal to a direction along which the laser pulses are introduced into the chamber. In some embodiments, the analyte molecules can be introduced into the ionization chamber in a direction substantially orthogonal to a longitudinal axis of the mass analyzer and the laser pulses can be introduced into the ionization chamber coaxially with the longitudinal axis of the mass analyzer. In some other embodiments, the analyte molecules can be introduced into the ionization chamber coaxially with the longitudinal axis of the mass analyzer and the laser pulses can be introduced into the ionization chamber in a direction substantially orthogonal to the longitudinal axis of the mass analyzer.

In some embodiments, an electric field can be established within the ionization chamber so as to facilitate the separation of the generated ions from electrons, thereby inhibiting those electrons from neutralizing the ions. In some embodiments, such an electric field can further facilitate the movement of the generated ions towards the aperture of the mass spectrometer.

In some embodiments, the sample can be an output of a gas chromatograph. In some embodiments, the sample can be desorbed from a surface by methods that include, but are not limited to, laser desorption and thermal desorption.

In further aspects, a method of performing mass spectrometry is disclosed, which comprises ionizing at least one analyte at an ambient pressure in a range of about $10^{-5}$ Torr to about $10^5$ Torr by exposing the analyte to one or more radiation pulses, e.g., laser pulses, having a pulsewidth in a range of about 2 fs to about 1 ps to cause ionization of the analyte, where the radiation pulses have a power density in a range of about 1 TW/cm$^2$ to about 1000 TW/cm$^2$. The ionized analyte can be directed to a mass analyzer for mass analysis In some embodiments of the above method of performing mass spectrometry, the applied radiation pulses cause non-resonant ionization of the analyte. In some embodiments, the pulsewidth of the applied pulses can be less than 1 ps, e.g., the pulsewidth can be in a range of about 50 fs to about 500 fs.

In some embodiments of the above method of performing mass spectrometry, the ambient pressure at which the analyte is subjected to the radiation pulses is in a range of about 1000 Torr to about $10^5$ Torr.

In further aspects, in a mass spectrometer, a method of ionizing an analyte is disclosed, which comprises irradiating the analyte at an ambient pressure in a range of about $10^{-5}$ Torr to about $10^5$ Torr with one or more radiation pulses, e.g., laser pulses, having a pulsewidth of about 2 fs to about 1 ps so as to cause non-resonant ionization of the analyte. The power density of each pulse can be in a range of about 1 TW/cm$^2$ to about 1000 TW/cm$^2$, for example, in a range of about 1 TW/cm$^2$ to about 300 TW/cm$^2$.

In further aspects, a method of ionizing a sample is disclosed that can comprise exposing a chemical ionization reagent to a plurality of laser pulses to cause the ionization of the reagent, and causing the ionized reagent to interact with a plurality of analyte molecules to cause ionization of the analyte molecules via ion-molecule collisions. In some embodiments, electrons released from ionization events are used as ionizing agents and the mass spectrometer is configured to sample negative ions. In some embodiments, the laser pulses employed to ionize the chemical ionization reagent can have a pulsewidth in a range of about 2 femtoseconds to about 1 picosecond, e.g., in a range of about 50 fs to about 500 fs, and can be applied to the chemical ionization reagent at a power density in a range of about 1 TW/cm$^2$ to about 1000 TW/cm$^2$, e.g., in a range of about 1 TW/cm$^2$ to about 300 TW/cm$^2$. In some embodiments, the ambient pressure at which the ionization of the chemical ionization reagent is achieved can be in a range of about $10^{-5}$ Torr to about $10^5$ Torr (e.g., in a range of about 1 atmosphere to about 100 atmospheres). In some embodiments, the ion-molecule collisions between the ionized chemical ionization reagent and the analyte molecules can occur at an ambient pressure in a range of about $10^{-5}$ Torr to about $10^5$ Torr. In some embodiments, the ionized analyte molecules can be directed to a mass spectrometer for mass analysis. Some examples of the chemical ionization reagent comprise, without limitation, Hydrogen ($H_2$), Deuterium ($D_2$), water ($H_2O$), Nitrogen ($N_2$), Oxygen ($O_2$), Methane ($CH_4$), benzene ($C_6H_6$), etc.

In further aspects, an ionization system is disclosed that can comprise a radiation source for generating radiation pulses having a pulsewidth in a range of about 2 fs to about 1 ps, e.g., in a range of about 50 fs to about 500 fs. The system can further comprise an ionization chamber for receiving an analyte. In some embodiments, the ionization system can comprise a channel that allows flowing an analyte (e.g., via a buffer gas) into the chamber. In some embodiments, the pressure within the ionization chamber is maintained in a range of about $10^{-5}$ to about $10^5$ Torr (e.g., in a range of about 1 atmosphere to about 100 atmospheres), e.g., by controlling the rate of gas flow into and out of the chamber. The ionization chamber can comprise an optical window that is transmissive to the radiation pulses to allow irradiating the sample with those radiation pulses. In some embodiments, the ionization system can further comprise an optical system (e.g., one or more lenses) for focusing the radiation pulses through the optical window into a focal volume within the ionization chamber so as to generate a radiation intensity in a range of about 1 TW/cm$^2$ to about 1000 TW/cm$^2$ within the focal volume, thereby ionizing at least a portion of the analyte molecules within that volume. The ionization chamber can be fluidly coupled to a mass spectrometer via an aperture, e.g., an aperture of a sampling cone, through which the ionized analyte molecules can enter the mass spectrometer.

In some embodiments of the above ionization system, an electrically conductive coating is disposed on a surface of the optical window, e.g., an inner surface of the optical window. The electrically conductive coating can be sufficiently thin to allow the passage of the radiation pulses into the chamber. By way of example, in some embodiments, the electrically conductive coating can be formed of any of Indium-Tin-Oxide, Aluminum, Tungsten, and Tantalum, and can have a thickness in a range of about 1 nm to about 1000 nm.

In some embodiments, the ionization system can comprise a voltage source configured to apply a voltage differential between one electrode and another electrode of an ionization system. In some embodiments, the ionization system can comprise a voltage source configured to apply a voltage differential between the electrically conductive coating disposed on a surface of the optical window and the sampling cone of a mass spectrometer coupled to the ionization source. The voltage differential can generate an electric field within the ionization chamber that can facilitate the separation of the generated ions from electrons, thereby inhibiting those electrons from neutralizing the ions (e.g., the positive ions). Further, the electric field can facilitate the introduction of the ions into the spectrometer by applying a force to the ions in the direction of a sampling aperture, for example, an aperture of a sampling cone, of the spectrometer through which the ions enter the spectrometer.

The ionization chamber can provide an interior volume having a variety of different shapes and dimensions. By way of example, in some embodiments, the interior volume of the ionization chamber can have an elongated cylindrical shape.

In some embodiments, the ionization system can comprise a first channel for introducing the analyte, which can be in a gaseous state, into the ionization chamber in a direction substantially coaxial with a longitudinal axis of the mass spectrometer to which the ionization chamber is coupled. In some such embodiments, the optical window can be positioned so as to allow the introduction of the laser pulses into the ionization chamber in a direction substantially orthogonal to the longitudinal axis of the mass spectrometer. In some embodiments, such introduction of the laser pulses can minimize the risk of damage to the sampling cone of the mass spectrometer due to misalignment of the optics directing the radiation pulses into the ionization chamber. In some embodiments, a second channel disposed substantially parallel to the first channel allows for the introduction of a carrier gas into the ionization chamber to carry the generated ions into the mass spectrometer.

In further aspects, an ionization system is disclosed that can comprise a first ionization chamber (herein also referred to as a "photoionization chamber") and a second ionization chamber (herein also referred to as a "chemical ionization chamber") that is fluidly coupled to the first chamber, e.g., via an opening. The second ionization chamber can be in fluid communication with a mass spectrometer, e.g., via an aperture of a sampling cone of the spectrometer.

The ionization system can further comprise a first channel for the introduction of a chemical ionization reagent into the first chamber and a second channel for the introduction of an analyte into the second chamber. The ionization system can further comprise an optical window that allows introducing radiation, e.g., laser pulses, into the first chamber so as to cause ionization of at least a portion of the chemical ionization reagent. The ionized chemical ionization reagent can flow into the second chamber to cause ionization of at least a portion of the analyte molecules via ion-molecule collisions. The ionized analyte molecules can be drawn into the mass spectrometer, e.g., via the aperture of the sampling cone of the spectrometer. In some embodiments, a third channel allows introducing a carrier gas into the first chamber and/or the second chamber to facilitate the flow of the chemical ionization reagent into the first chamber and/or the analyte into the second chamber.

In further aspects, a mass spectrometer is disclosed that can comprise an ionization system and an ion mobility spectrometer coupled to said ionization system to receive ions generated therefrom. The ionization system can comprise a laser configured to provide laser pulses having a pulsewidth in a range of about 2 fs to about 1 ps. The ionization system can also comprise a first ionization chamber having an optical window transmissive to said laser pulses to allow the passage of the pulses into an interior volume thereof, said first chamber being configured to receive a chemical ionization reagent. The ionization system can also comprise a second ionization chamber in fluid communication with said first chamber and configured to receive an analyte, and an optical system for focusing said laser pulses into a focal volume of said first ionization chamber so as to generate a laser radiation intensity in a range of about 1 $TW/cm^2$ to about 1000 $TW/cm^2$ in said focal volume, thereby causing ionization of at least a portion of said chemical ionization reagent in said focal volume. In some embodiments, at least a portion of the ionized chemical ionization reagent flows from said first chamber to said second chamber to ionize at least a portion of the analyte in said second chamber via ion-molecule reactions. In some embodiments, the second ionization chamber is configured for coupling to a mass analyzer for delivering the ionized analyte to the mass analyzer. In some embodiments, the pressure within the first chamber is in a range of about $10^{-5}$ Torr to about $10^5$ Torr. In yet more embodiments, an ion mobility spectrometer is coupled to the ionization system to receive ions generated therefrom.

Further understanding of the invention can be obtained by reference to the following detailed description in conjunction with the associated drawings, which are briefly discussed below.

BRIEF DESCRIPTION OF THE DRAWINGS

The skilled person in the art will understand that the drawings, described below, are for illustration purposes only. The drawings are not intended to limit the scope of the applicants' teachings in any way. The applicants' teachings will be more fully understood from the following description of various embodiments taken in conjunction with the accompanying drawings, in which.

DETAILED DESCRIPTION OF VARIOUS EMBODIMENTS

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the systems, devices, and methods described herein. Further, a person skilled in the art will understand instances in which like-numbered components of illustrated embodiments generally have at least some similar features, and thus within some embodiments each feature of a like-numbered component is not necessarily fully elaborated upon.

The applicants' teachings generally provide ionization methods and devices for use in mass spectrometry. As discussed in more detail below, in many embodiments, the ionization methods and devices according to the applicants' teachings employ short laser pulses (e.g., pulses having pulsewidths in a range of about 2 fs to about 1 ps) at a high intensity (e.g., an intensity in a range of about 1 TW/cm$^2$ to about 1000 TW/cm$^2$) to ionize an analyte at an ambient pressure greater than about $10^{-5}$ Torr (e.g., an ambient pressure in a range of about 1 atmosphere to about 100 atmospheres). In some embodiments, the analyte can be ionized at an ambient pressure of about 1 atmosphere. In some other embodiments, the analyte can be ionized at an ambient temperature between about 2 atmospheres and about 6 atmospheres.

Various abbreviations are used herein consistent with their ordinary use in the art. For example, the following abbreviations are herein employed:

"fs" denotes femtosecond (i.e., $10^{-15}$ seconds)
"ps" denotes picoseconds (i.e., $10^{-12}$ seconds)
"PW" denotes petaawatts (i.e., $10^{15}$ watts)
"TW" denotes terawatts (i.e., $10^{12}$ watts)
"micron" denotes micrometers (i.e., $10^{-6}$ meters)
"MV" denotes megavolts (i.e., $10^6$ volts)
"μJ" denotes microjoules (i.e., $10^{-6}$ joules)

In addition, the terms "power density" and "intensity" are used herein interchangeably to refer to power per unit area. As used herein, the term "mass spectrometer" comprises any system suitable for mass analysis, such as ion mobility (IM) systems, hybrid ion mobility mass spectrometer (IM-MS) systems, variations on such systems (e.g., MS-IM-MS), time of flight (TOF) mass spectrometers, differential mobility systems, quadrupole systems, and various others and/or combinations thereof.

Figure 1:
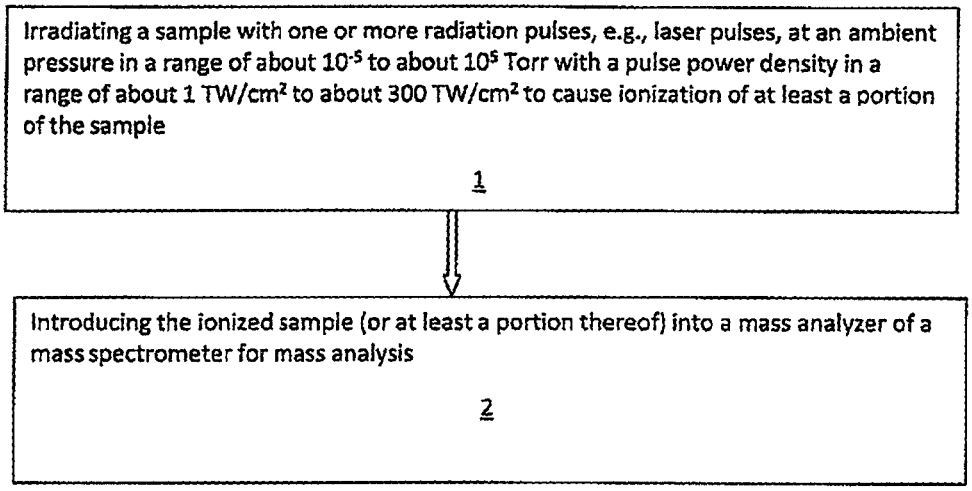
FIG. 1 is a flow chart depicting various steps in an ionization method according to an embodiment of the applicants' teachings.

FIG. 1 is a flow chart depicting various steps of a method according to an embodiment of the applicants' teachings for ionizing a sample, e.g., for analysis by a mass analyzer of a mass spectrometer. The method can comprise irradiating the sample at an ambient pressure in a range of about $10^{-5}$ Torr to about $10^5$ Torr with one or more radiation pulses, e.g., laser pulses, having a pulsewidth in range of about 2 femtoseconds to about 1 picosecond at a pulse power density in a range of about 1 TW/cm$^2$ to about 1000 TW/cm$^2$ to cause ionization of at least a portion of the sample (step 1).

In some embodiments, the sample can be introduced into an ionization chamber and the radiation pulses can be focused into the chamber, e.g., via a radiation-transmissive optical window, onto a focal volume through which the sample flows. For example, in some embodiments, the sample can be introduced into the ionization chamber via a carrier gas (e.g., a noble gas such as helium).

In some embodiments, the ionized sample can be introduced into a mass analyzer for mass analysis (step 2). A variety of mass analyzers can be employed. Some examples of such mass analyzers comprise, without limitation, time-of-flight (TOF) analyzers, quadrupole analyzers, and ion trap analyzers. Further examples can comprise ion mobility spectrometers and ion mobility setups in combination with mass spectrometers. In some cases, the mass analyzer can provide multiple stages of mass analysis, e.g., MS/MS. By way of example, in some such embodiments, the ions introduced into the mass analyzer can be filtered, fragmented, and the ion fragments can be mass analyzed.

In some embodiments, the radiation pulses can have a pulsewidth in a range of about 50 fs to about 500 fs, e.g., in a range of about 50 fs to about 100 fs. Further, the central wavelength of the applied pulses can be, e.g., in a range of about 200 nm to about 100 micrometers (microns). In some embodiments, the central wavelength of the applied radiation pulses can be in a range of about 800 nm to about 3 microns. A wide range of repetition rates can be employed for application of the radiation pulses to the sample. By way of example, the repetition rate of the pulses can be in a range of about 1 Hz to about 100 MHz.

As noted above, in some embodiments, the ambient pressure at which the ionization of the sample, via application of the short laser pulses, is achieved is at least about $10^{-5}$ Torr. In many embodiments, the ambient pressure can be in a range of about 1 atmosphere (760 Torr) to about 100 atmospheres (76000 Torr). As discussed in more detail below, the high ambient pressure can increase the sample density at the focal volume of the applied pulses, thereby enhancing the number of generated ions.

In some embodiments, the high power density of the applied pulses can cause non-resonant ionization of one or more analytes of the sample. In other words, in some embodiments, the central wavelength of the pulses does not need to be tuned to a particular absorption line of the molecule(s) of interest. Without being limited to any particular theory, the applied pulses subject one or more analytes present in the sample to a high electric field (e.g., on the order of 100 megavolts/cm (MV/cm)) that is sufficiently strong to pull one or more electrons off analyte molecule(s), e.g., via quantum mechanical tunneling and/or other multiphoton adsorption processes. As the electric field (E) is related to the power density of the pulses (P) by the following relation: ($E \sim \sqrt{P}$), sufficiently high power densities, such as those discussed above, are generally required to cause non-resonant ionization of the analyte molecules.

The above ionization method can be widely applicable for ionizing a variety of analytes including both organic and inorganic molecules with an ionization efficiency that can approach, in some cases, 100%.

Further, in many embodiments, ionizing the analyte by application of laser pulses having short pulsewidths in the presence of a buffer gas at an elevated pressure, such as the above pressures, can inhibit fragmentation of the generated ions. Without being limited to any particular theory, it is known that it takes a certain amount of time for excited ions to fragment. Therefore, even if the applied pulses cause internal excitation of the generated ions, in many cases, the fragmentation of such excited ions can still be suppressed via quenching of the excitation through collisional cooling with the buffer gas.

Figure 2:
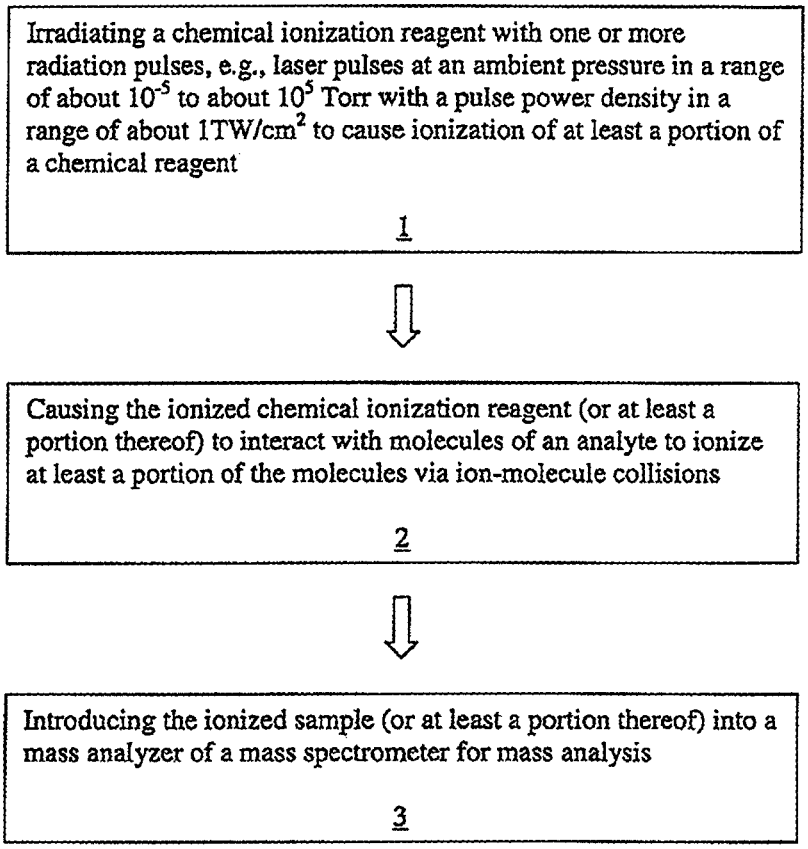
FIG. 2 is a flow chart depicting various steps in an ionization method according to an embodiment of the applicants' teachings in which a photoionization step is performed to ionize a chemical ionization reagent and the ionized chemical ionization reagent is employed to ionize an analyte of interest, FIG. 3 schematically depicts an ionization source according to an embodiment of the applicants' teachings, FIG. 4 schematically depicts an ionization source according to an embodiment of the applicants' teachings, FIG. 5 schematically depicts an ionization source according to an embodiment of the applicants' teachings, FIG. 6 schematically depicts an ionization source according to an embodiment of the applicants' teachings, FIG. 7 schematically depicts the application of a train of voltage pulses to the thin conductive coating on the inner surface of the radiation transmissive window of the ionization source of FIG. 5, FIG. 8 schematically depicts an exemplary system for synchronizing the application of voltage pulses to the conductive coating with the application of laser pulses to the sample in the embodiment of FIG. 7, FIG. 9 schematically depicts an ionization source according to an embodiment of the applicants' teachings.

FIG. 2 is a flow chart depicting various steps of a method according to another embodiment according to the applicants' teachings for ionizing a sample, e.g., for analysis by a mass analyzer of a mass spectrometer, wherein short laser pulses can be employed to ionize a chemical ionization reagent, which can in turn ionize an analyte of interest. In some embodiments, the method can comprise irradiating a chemical ionization reagent at an ambient pressure in a range of about $10^{-5}$ Torr to about $10^{5}$ Torr with one or more radiation pulses, e.g., laser pulses, having a pulsewidth in a range of about 2 femtoseconds to about 1 picosecond at a pulse power density in a range of about 1 $TW/cm^2$ to about 1000 $TW/cm^2$ to cause ionization of at least a portion of the chemical ionization reagent (step 1). Some examples of the chemical ionization reagent comprise, without limitation, Hydrogen ($H_2$), Deuterium ($D_2$), water ($H_2O$), Nitrogen ($N_2$), Oxygen ($O_2$), Methane ($CH_4$), benzene ($C_6H_6$), etc. The ionized chemical ionization reagent can be caused to interact with a plurality of analyte molecules, for example, by flowing the ionized chemical ionization reagent into a chamber containing the analyte molecules, to ionize the analyte molecules via ion-molecule reactions (step 2). The ionized analyte molecules can be directed to a mass analyzer of a mass spectrometer for mass analysis (step 3).

Figure 3:
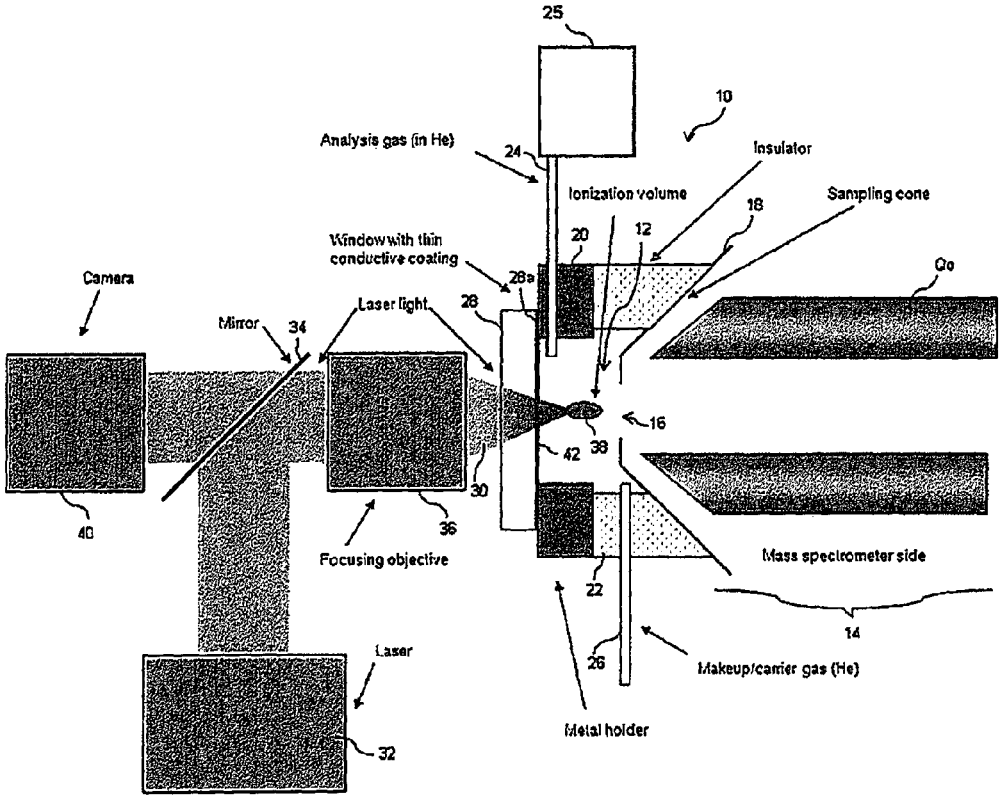

The above methods for ionizing a sample can be implemented in a variety of ways. By way of example, FIG. 3 schematically depicts an ionization source 10 according to an embodiment. The ionization source 10 can comprise an ionization chamber 12 (herein also referred to as an ionization cell) for receiving an analyte of interest so as to expose the analyte to short laser pulses suitable for ionizing the analyte. The ionization chamber 12 can be connected to a mass spectrometer (shown only partially) via an aperture 16 of a sampling cone 18 through which ions generated in the ionization chamber can pass to enter the spectrometer. In some embodiments, the mass spectrometer can comprise one or more quadrupole ion guides and analyzers. For example, in this illustrative embodiment, an ion guide Q0 focuses and guides the ions entering through the aperture of the sampling cone to other stages of the mass spectrometer (not shown). It should, however, be understood that the applicants' teachings for generating ions are not limited to a particular type of mass spectrometer, but can be utilized with a variety of mass spectrometers using a variety of different mass analyzers, such as, quadrupole, time-of-flight (TOF), and differential mobility analyzers, among others.

In this illustrative embodiment, the ionization chamber can comprise an annular metal holder 20 that is coupled to an electrically insulating section 22. The electrically insulating section 22 can comprise any of a variety of materials, including without limitation, ceramic, glass, or plastic. In some embodiments, the ion source can be heated, as this can speed up removal of contaminants such as water and other species. Heat can also help to prevent analyte ions from sticking to the surfaces and creating memory effects. Accordingly high temperature plastics or ceramics can be used in some embodiments. A channel 24 extends through the metal holder 20 into the ionization chamber to provide a passageway for delivery of an analyte, which can be in many embodiments in a gaseous state (herein also referred to as the analysis gas), into the ionization chamber 12, e.g., via a buffer gas, such as helium. The analyte can be provided in a variety of ways. For example, the sample can be the output of a gas chromatograph, a liquid chromatograph, or other source 25. In some embodiments, the channel 24 can have a cylindrical shape, though other shapes can also be utilized. Another channel 26 extends through the insulating section 22 into the ionization chamber to provide a passageway for delivery of a carrier gas into the ionization chamber to carry the generated ions to the aperture of the sampling cone 18. In some embodiments, the second channel 26 can have a cylindrical shape, though in other embodiments different shapes can be utilized. At least a portion of the ion source can be made using microfabrication techniques similar to those used in lab-on-a-chip workflows or LC/GC-on-a-chip workflows, as known in the art.

In this illustrative embodiment, a radiation-transmissive optical window 28 is coupled to the metal holder 20 and allows the passage of ionizing radiation 30 from an external radiation source 32 into the ionization chamber 12. The material from which the optical window 28 is formed can be selected based on the wavelength of the ionizing radiation 30 to allow the passage of that radiation into the chamber 12. A variety of radiation sources providing ionizing radiation can be employed. In some embodiments, the radiation source provides short laser pulses, e.g., pulses having a pulsewidth in a range of about 2 femtoseconds to about 1 picosecond. By way of example, in some embodiments, the radiation source can comprise a Ti:Sapphire laser configured to provide femtosecond pulses, e.g., pulses having a pulsewidth in range of about 2 fs to about 100 fs. In some embodiments, the radiation source can comprise a fiber laser configured to provide femtosecond pulses.

In this illustrative embodiment, a dichroic mirror 34 receives the radiation pulses generated by the radiation source 32 and reflects the radiation pulses onto a focusing objective 36, which in turn focuses the radiation pulses into a focal volume 38 (herein also referred to as the ionization volume) within the ionization chamber 12. In some embodiments, the focusing objective 36 can be mounted on an xyz translation stage to allow directing the radiation pulses into a desired volume within the ionization chamber.

A camera 40 can be positioned behind the dichroic mirror 34 to allow viewing the ionization chamber. In some embodiments, the ionization chamber 12 can be utilized, e.g., for aligning the laser radiation relative to the ionization chamber.

In some embodiments, the optical window 28 can comprise a transparent electrically conductive coating 42 that is disposed on its inner surface 28*a* of the window 28. In some embodiments, the transparent conductive coating 42 can be in the form of a thin metal coating (e.g., a coating comprising Indium-Tin-Oxide, Aluminum, Tungsten, and/or Tantalum). In some embodiments, the thickness of the metal coating can be in a range of about 1 nm to about 1000 nm.

In some embodiments, a potential difference applied between this thin metal coating 42 and the sampling cone 18 can generate an electric field within the ionization chamber, which can separate the generated positive ions from electrons so as to prevent neutralization of the ions by those electrons. The electric field can further urge the ions toward the aperture of the sampling cone to facilitate their introduction into the mass spectrometer.

The pressure within the ionization chamber 12 can be maintained within a desired range (or at a desired value) by balancing the rate of flow of the analysis gas and the carrier gas into the chamber with the pumping rate of the gas out of the ionization chamber into the mass spectrometer through the aperture 16 of the sampling cone 18. In some embodiments, the pressure within the ionization chamber 12 can be maintained in a range of about $10^{-5}$ Torr to about $10^{5}$ Torr. A pressure gauge (not shown) can be employed to monitor the pressure within the ionization chamber. Make-up flow control and the pressure gauge can be utilized to maintain the pressure in the ionization chamber at a desired level.

In use, in some embodiments, a sample to be analyzed is introduced via the channel 24 into the ionization chamber. In some embodiments, the sample can be introduced into the ionization chamber via the flow of a buffer gas, such as helium. As the sample passes through the focal volume 38, it can be ionized via the laser pulses. In some embodiments, the power density of the laser pulses within the focal volume is sufficiently high, e.g., in a range of about 1 $TW/cm^2$ to about 1000 $TW/cm^2$, to cause non-resonant ionization of the sample. The generated ions can be carried via the carrier gas to the orifice of the sampling cone of the mass spectrometer.

As discussed above, the high pressure within the ionization chamber can lead to a high concentration of the sample molecules within the focal volume, thereby enhancing the ionization efficiency. Further, in some embodiments, the high pressure within the ionization chamber can enhance collisional cooling of the generated ions to prevent their dissociation due to high internal energies.

Figure 4:
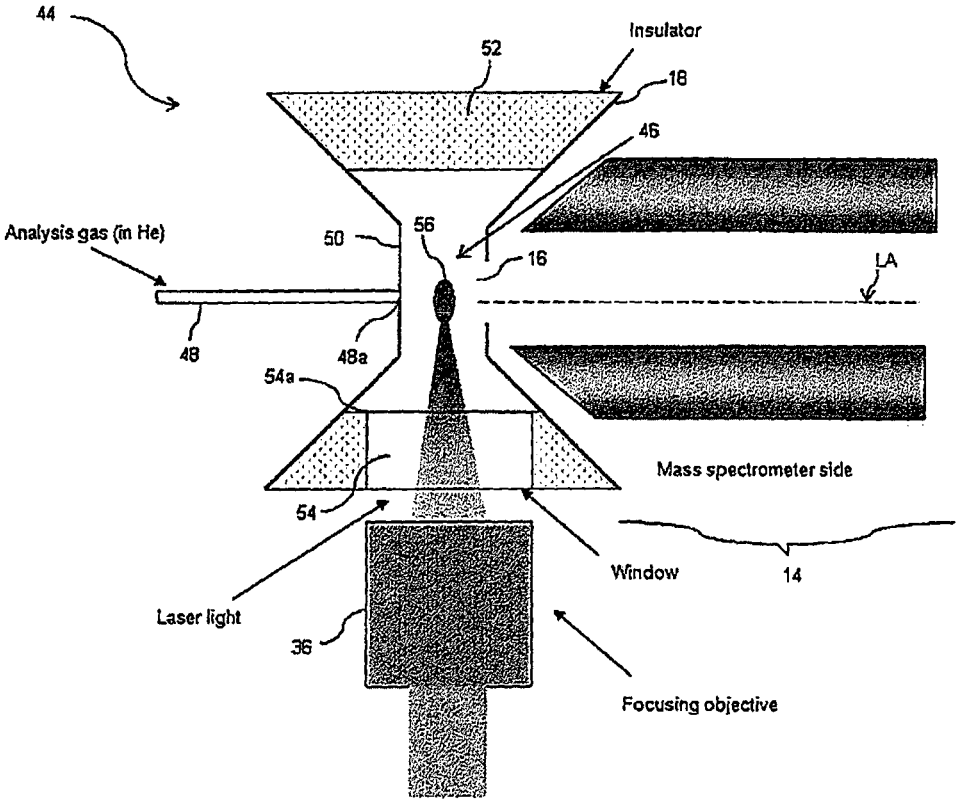

FIG. 4 schematically depicts an ionization source 44 according to another embodiment that can comprise an ionization chamber 46 that is coupled to the mass spectrometer 14 (shown only partially) via the aperture 16 of the sampling cone 18 of the spectrometer. A channel 48 having an opening 48*a* formed within an end wall 50 of the chamber can allow the delivery of a sample (analyte) into the ionization chamber 46. In some embodiments, a buffer gas can be employed to carry the sample (which can be in some embodiments in the gaseous form, which is also referred to herein as the analysis gas) through the opening 48*a* into the ionization chamber. In this illustrative embodiment, the opening 48*a* of the channel 48 is positioned opposed to the aperture 16 of the mass spectrometer such that the sample is introduced into the chamber coaxially relative to the longitudinal axis (LA) of the spectrometer. In other embodiments, the channel 48 can be configured to allow delivery of the analysis gas into the ionization chamber perpendicular to the longitudinal axis of the spectrometer, or in any other direction.

With continued reference to FIG. 4, in this illustrative embodiment, a circumferential wall 52 of the ionization chamber is formed of an electrically insulating material. A window 54 is formed in a portion of the insulating wall 52 to allow the passage of laser pulses generated by a source (not shown in this figure) into the ionization chamber along a direction that is orthogonal to the longitudinal axis (LA) of the mass spectrometer (i.e., it forms a 90-degree angle relative to the longitudinal axis of the spectrometer). A focusing objective 36 focuses the radiation pulses into a focal volume 56 to generate a sufficiently high power density in that volume to cause ionization of the sample (e.g., analysis gas) as it passes through that focal volume. The generated ions are carried in the mass spectrometer through the aperture 16. In some embodiments, the aperture can be round. In other embodiments, the aperture can be or can include a slit or any other shape that facilitates efficient sampling of ions while minimizing sampling of the buffer gas.

Similar to the previous embodiment, a thin electrically conductive layer 54*a* can be disposed on an inner surface of the window 54. The application of a voltage differential between the electrically conductive surface 50 and the sampling cone results in an electric field that can separate the generated ions from electrons, thereby inhibiting those electrons from neutralizing the ions. The field can also be created between the electrodes 50 and 18.

In this illustrative embodiment, the introduction of the laser pulses in a direction orthogonal to the longitudinal axis of the mass spectrometer can reduce, and in some embodiments can eliminate, the risk of damage to the sampling cone due to a misalignment of the optics directing the radiation into the ionization chamber.

Figure 5:
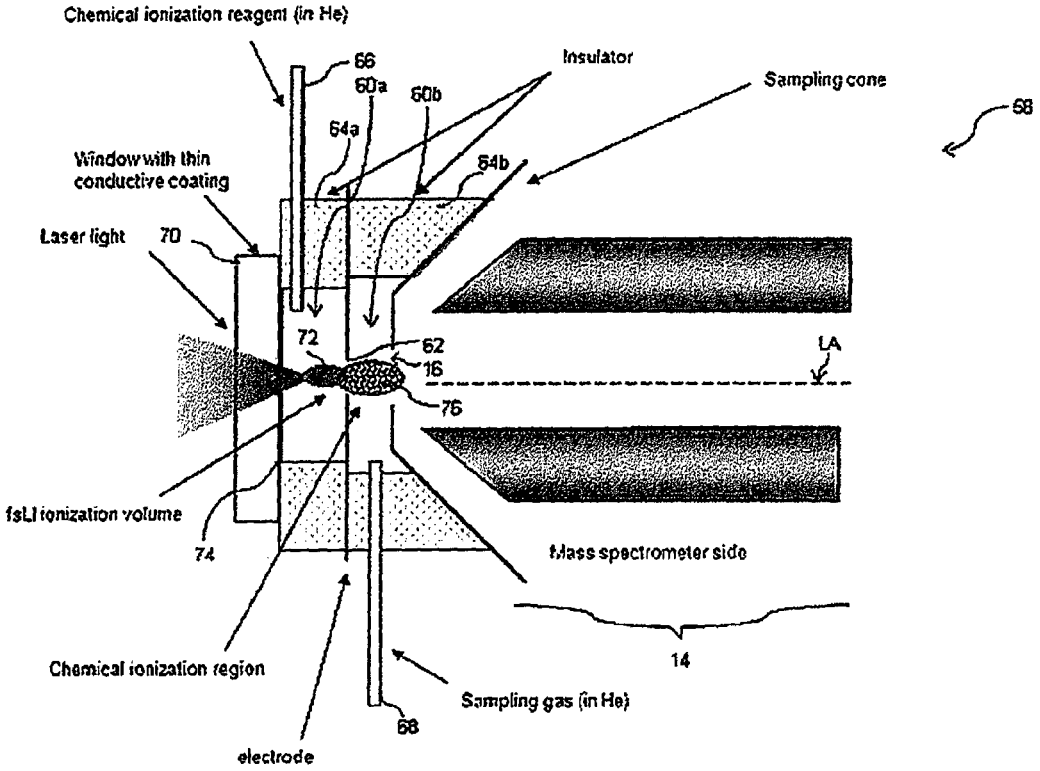

In some embodiments, short laser pulses can be employed to ionize a chemical ionization reagent, which can in turn ionize an analyte of interest. By way of illustration, FIG. 5 schematically depicts an ionization source 58 according to an embodiment in which laser pulses are employed to ionize a chemical ionization reagent, which can in turn ionize an analyte of interest. The illustrative ionization source 58 can comprise two ionization chambers 60*a* and 60*b* that are coupled to one another via an opening 62. As discussed below, a chemical ionization reagent can be ionized in the chamber 60*a* (herein also referred to as the "photoionization chamber") via application of short laser pulses (e.g., femtosecond pulses). The ionized chemical ionization reagent can flow into the second ionization chamber 60*b* (herein also referred to as the "chemical ionization chamber") to ionize an analyte of interest that has been introduced into that chamber. In this illustrative embodiment, the peripheral walls 64*a* and 64*b* of the ionization chambers 60*a* and 60*b* are formed of an electrically insulating material. The ionization reagent can also comprise negative ions created via interaction of electrons produced by the laser pulse and reagent molecules. In such cases, negative reagent ions can produce negative analyte ions and the mass spectrometer can analyze these analyte ions in a negative ion mode.

In this illustrative embodiment, a channel 66 extends through the peripheral wall 64*a* of the ionization chamber 60*a* to provide a passageway for the introduction of a chemical ionization agent into that chamber. And a channel 68 extends through the peripheral wall 64*b* of the ionization chamber 60*b* to provide a passageway for the introduction of a sample (analyte) of interest into that chamber. In this illustrative embodiment, the channels 66 and 68 are configured so as to introduce a flow of the chemical ionization reagent and the sample, e.g., via buffer gas, into the respective chambers in a direction orthogonal to a longitudinal axis (LA) of the mass spectrometer.

A window 70 disposed at one end of the ionization chamber 60*a* allows the passage of laser radiation, which can be in the form of short laser pulses, into the ionization chamber 60*a*. Focusing optics (not shown) can focus the laser pulses into a focal volume 72 within the ionization chamber 60*a* to cause ionization of the chemical ionization reagent as it passes through the focal volume 72.

In some embodiments, the power density of the laser pulses in the focal volume 72 can be in a range of about 1 $TW/cm^2$ to about 1000 $TW/cm^2$. In some embodiments, the pressure within the ionization chamber 60*a* can be maintained in a range of about $10^{-5}$ Torr to about $10^5$ Torr, e.g., by balancing the inflow and the outflow rate of gas into and out of the chamber 60*a*. The pressure within the ionization chamber 60*b* can be maintained in this range, e.g., by adjusting the inflow of gas into the chamber 60*b* and outflow of gas out of the chamber 60*b*. In some embodiments, the pressure within the chemical ionization chamber 60*b* is similar to the pressure within the photoionization chamber 60*a*. In other embodiments, the pressure within the chemical ionization chamber can be lower than the pressure within the photoionization chamber 60*b*. In some embodiments, the ratio between the absolute pressure in the photoionization chamber and the absolute pressure in the chemical ionization chamber is below about 2, whereas in other embodiments this ratio can be at least about 2. When this ratio is at-least about 2, it can lead in some instances to the formation of a supersonic jet issuing from the chamber 60*a* into the chamber 60*b*.

Similar to previous embodiments, a thin electrically conductive layer 74 can be disposed on an inner surface of the window 70, where the application of a voltage differential between this thin metallic layer and the electrode separating 60*a* and 60*b* can cause separation of the generated ions of the chemical ionization reagent and electrons, thereby inhibiting those electrons from neutralizing the ions. Potential difference between the separation electrode and the sampling cone can be used to control the residence time of the reagent ions in the chemical ionization region 76.

The ions of the chemical ionization reagent pass through the aperture 62 to enter the second ionization chamber 60*b* (i.e., the chemical ionization chamber) in which they encounter the sample molecules introduced into the chamber 60*b* via the channel 68. In some embodiments, a carrier gas, such as helium, can be employed to facilitate the introduction of the sample molecules into the chamber 60*b*. The ions of the chemical ionization reagent can cause ionization of the sample molecules via ion-molecule collisions, e.g., within a chemical ionization region 76. The ionized sample molecules are drawn into the mass spectrometer via the aperture 16 in the sampling cone of the spectrometer.

Figure 6:
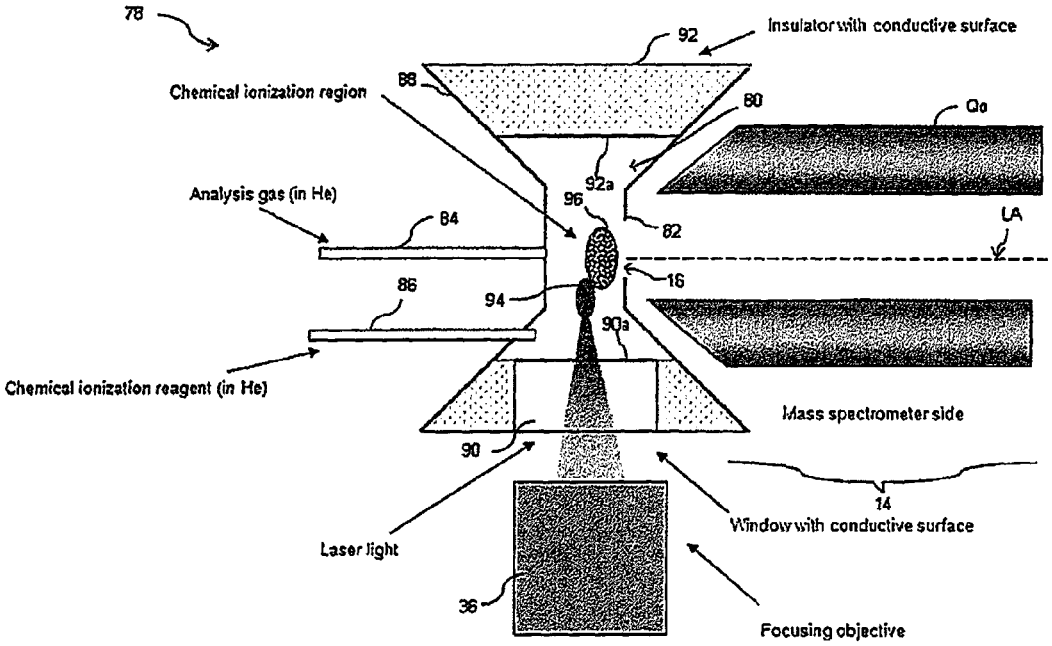

FIG. 6 schematically depicts an ionization source 78 according to another embodiment of the applicants' teachings, which can comprise an ionization chamber 80 that is coupled to a mass spectrometer 14 (shown only partially) via an aperture 16 of a sampling cone 82 of the spectrometer. Two channels 84 and 86 formed in an end wall 88 of the chamber opposed to the sampling cone allow the introduction of an analyte, e.g., as an analysis gas, and a chemical ionization agent, e.g., via a carrier gas, respectively, into the ionization chamber 80. The channel 84 allows introducing a flow of the analyte into the ionization chamber along a direction substantially coaxial with a longitudinal axis (LA) of the mass spectrometer. In this illustrative embodiment, the channel 86 is positioned substantially parallel to the channel 84 with an offset that allows the introduction of the chemical ionization reagent closer to a window 90. The window 90 is formed in an electrically insulating annular wall 92 of the chamber 80 to allow the passage of laser radiation, e.g., short radiation pulses, into the chamber in a direction orthogonal to the longitudinal axis (LA) of the mass spectrometer. The laser pulses can be focused by a focusing objective 36 into a focal volume 94 to cause ionization of the chemical ionization reagent, e.g., via non-resonant ionization.

Similar to the previous embodiments, a thin electrically conductive coating 90*a* can be disposed on an inner surface of the window 90. Further, an electrically conductive layer 92*a* (e.g., a metallic layer) can be formed on at least a portion of an inner surface of the insulating wall 92. The application of a voltage differential between the thin electrically conductive coating 90*a* and the sampling cone and/or between the electrically conductive layer 92*a* and the sampling cone results in an electric field that can help drive the generated ions toward the aperture 16 of the sampling cone. In some embodiments, such an electric filed can help separate the generated ions from electrons, thus inhibiting the electrons from neutralizing the ions.

The ions of the chemical ionization agent then drift toward the flow of the analyte, e.g., via the flow of the carrier gas in which the chemical ionization reagent is entrained, to cause ionization of the analyte molecules via ion-molecule collisions, e.g., within a chemical ionization region 96. The ionized analyte molecules can be drawn through the aperture 16 into the mass spectrometer.

In some embodiments, an electric field applied in the ionization region can be pulsed in synchrony with the applied laser pulses to help separate generated positively charged species from electrons immediately after each ionization event caused by a laser pulse. Such separation of the positively charged ions and electron clouds, mediated by applied voltage pulses, can prevent recombination events that can lead to neutralization of the ions.

Figure 7:
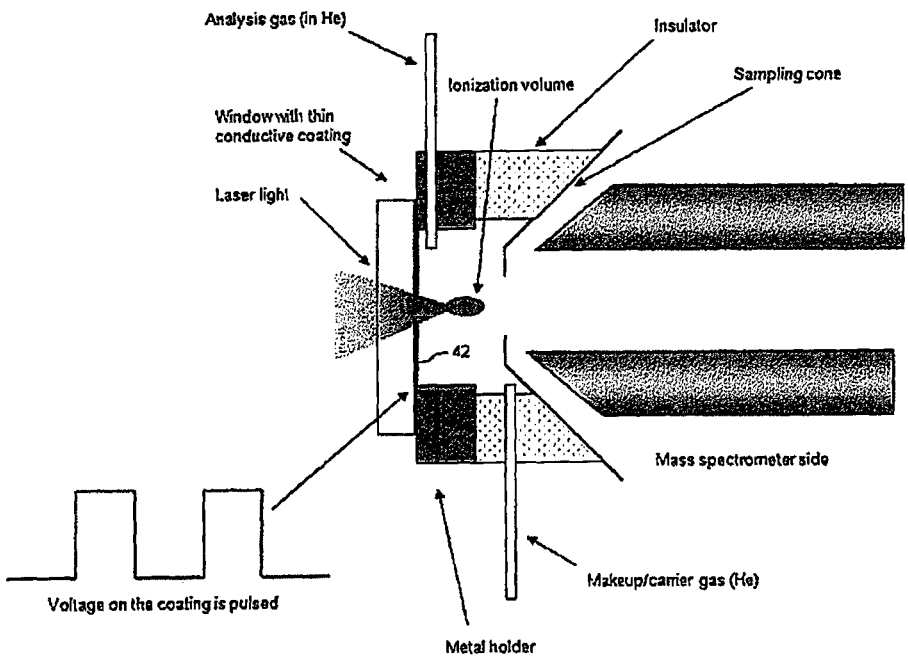

In some embodiments in which the laser pulses ionize a chemical ionization reagent that subsequently causes ionization of an analyte, once the positive and negative charge clouds are separate, the applied voltage differential can be lowered (or turned off) to promote chemical ionization (assisted by longer residence time) and/or improve efficiency of sampling by allowing gas dynamics to transfer the ions to the next stage. By way of example, FIG. 7 schematically depicts the application of a train of voltage pulses to the thin electrically conductive coating on the inner surface of the radiation transmissive window 42 of the ionization source 10 discussed above. In some embodiments, the voltage pulses can be synchronized with the laser pulses so that they are applied to the conductive coating substantially concurrently with the application of the laser pulses to the sample within the ionization chamber.

Figure 8:
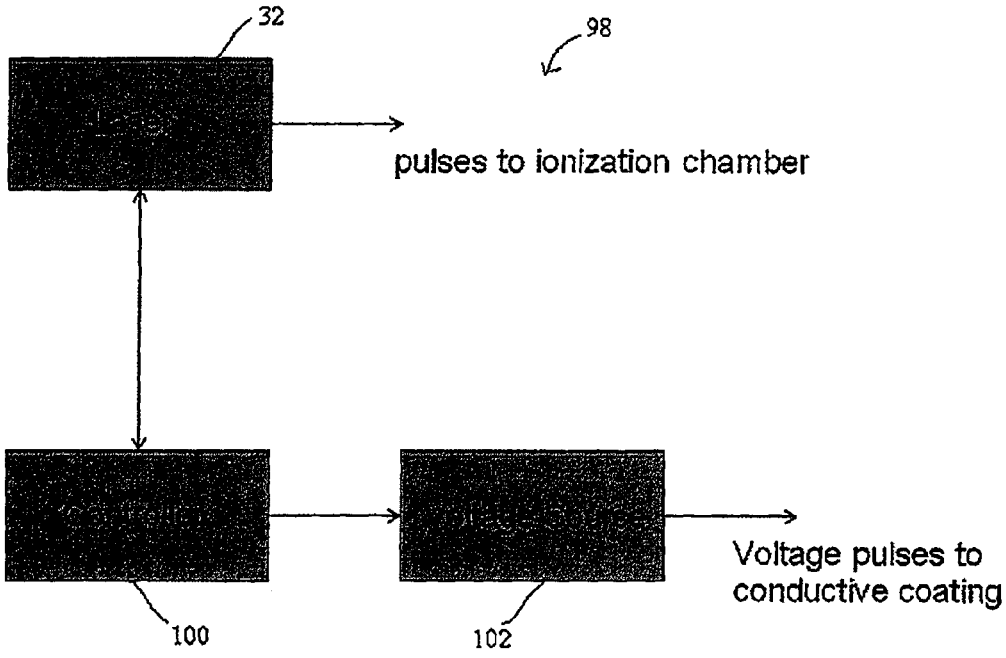

By way of example, FIG. 8 schematically depicts an exemplary system 98 for synchronizing the application of the laser and voltage pulses, which can employed, e.g., in the ionization source 10 for synchronizing the application of voltage pulses to the electrically conductive coating 42 with the application of laser pulses to the sample. The illustrative system 98 can include a controller 100 that is in electrical communication with the laser source 32 and a voltage source 102. The laser source 32 can be configured to transmit a trigger signal to the controller upon generation of a laser pulse. In response to the trigger signal, the controller 100 can instruct the voltage source, e.g., via application of appropriate control signals, to apply a voltage pulse to the conductive coating 42.

Figure 9:
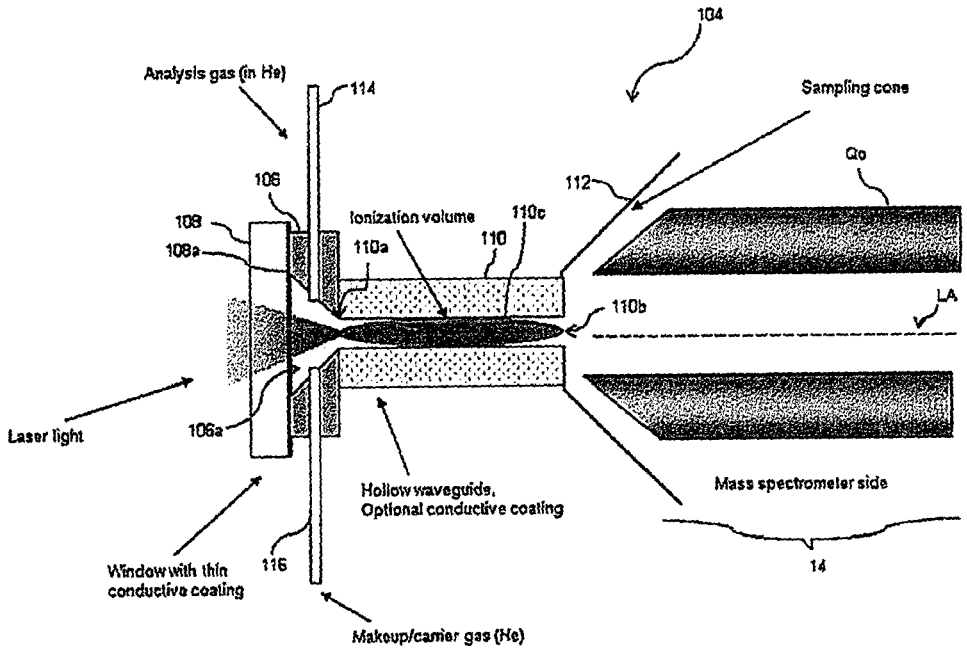

FIG. 9 schematically depicts an ionization source 104 according to another embodiment that can comprise a holder 106, e.g., a metal holder, to which a radiation transmissive window 108 is coupled. The holder 106 provides an interior volume 106*a* that tapers from the window 108 to a first open end 110*a* of an elongated hollow structure 110 (herein also referred to as a "hollow waveguide"), such as a hollow cylindrical structure, that provides an internal volume in which ionization of an analyte, in response to application of laser pulses, can occur. In this illustrative embodiment, the opposed second open end 110*b* of the hollow waveguide 110 forms an aperture of a sampling cone of the mass spectrometer 14 (only partially shown).

A channel 114 extends through the holder 106 to allow the delivery of a sample (an analyte), e.g., via the flow of a buffer gas, such as helium, into the volume 106*a* in a direction orthogonal to a longitudinal axis (LA) of the mass spectrometer 14. Another channel 116 extends through another portion of the holder 106 to provide a passageway for the delivery of a makeup/carrier gas, such as helium, into the interior volume 106*a*. The gases introduced into the interior volume 106*a* pass through the aperture 110*a* to reach the interior of the waveguide 110.

In use, laser pulses generated by a source (not shown in this figure) can be focused via a focusing optic through the radiation transmissive window 108 into the interior volume of the waveguide 110 so as to ionize analyte molecules passing through that volume. The ionized analyte molecules are drawn through the aperture 110*b* into the sampling cone to enter the mass spectrometer 14. In some embodiments, the use of the hollow waveguide can increase the ionization volume, and thus the ionization efficiency. In some embodiments, the waveguide 110 can be constructed of a semiconductor material or have a resistive coating on its interior wall such that a potential gradient can be maintained along its length to facilitate the movement of ions through the waveguide into the mass spectrometer.

In this illustrative embodiment, a thin electrically conductive coating 108*a* can be disposed on an inner surface of the window 108. The application of a voltage differential between the electrically conductive coating 108*a* and the sampling cone 112 can generate an electric field that can facilitate the movement of the generated ions toward the aperture 110*b*. In some embodiments, an electrically conductive layer 110*c* can be disposed on at least a portion of an inner surface of the waveguide 110. The application of a voltage differential between such an electrically conductive coating and the sampling cone can also facilitate the movement of the ions towards the aperture 110*b*.

Aspects of the applicants' teachings may be further understood in light of the following examples, which should not be construed as limiting the scope of the applicants' teachings in any way.

EXAMPLE

Figure 10:
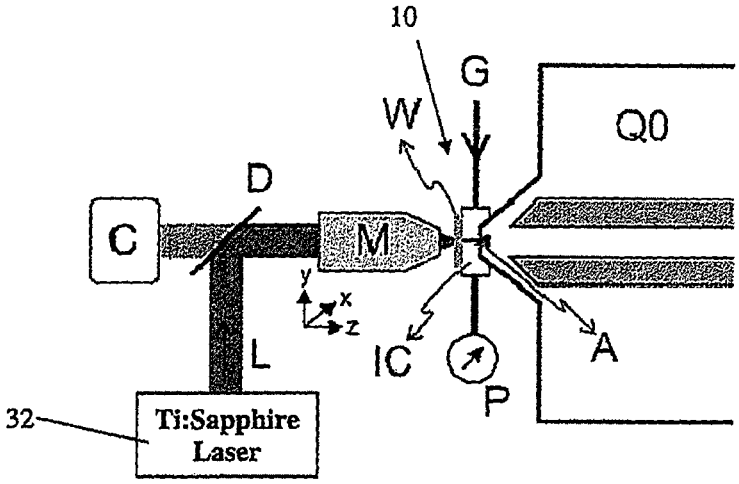
FIG. 10 depicts a setup for performing mass spectroscopy by utilizing high pressure femtosecond laser ionization according to an embodiment of the applicants' teachings.

A quadrupole/time-of-flight MS/MS instrument marketed by AB Sciex of Concord, Canada under the trade designation QStar XL was modified by replacing an electrospray front-end of the instrument with a custom built ionization interface according to the applicants' teachings, as shown schematically in FIG. 10. The ionization cell, IC, is connected to the mass spectrometer quadrupole ion guide inlet chamber, Q0, by a small aperture, A. A femtosecond laser beam L generated by a radiation source 32 (e.g., a Ti:Sapphire laser having a pulsewidth of about 50 fs) is reflected off a dichroic mirror D and is focused via a microscope objective M, mounted on an xyz translation stage, into the ionization cell IC via a widow W of the cell. The window has a transparent conductive coating on the inside surface that can be biased to push the generated ions toward the aperture. Gas enters the ionization cell IC through an inlet G. The pressure within the ionization cell IC, which is maintained by balancing the inlet flow with the pumping rate through the aperture, is measured by a pressure gauge P. A camera C, which is set up to view the aperture through the mirror D, is used to assist with laser alignment.

Ionization of an analyte delivered to the ionization cell takes place at the focus of the femtosecond laser beam directly in front of the small aperture connecting the ionization cell to the quadrupole ion guide inlet chamber Q0 of the mass spectrometer. Because non-resonant femtosecond laser ionization requires intense fields, ionization is confined to the focal region. Ions are pulled into the inlet chamber Q0 by the flow of gas driven by a pressure differential between the ionization cell IC and the inlet chamber Q0. The flow of the ions from the ionization chamber IC into the inlet chamber Q0 is facilitated by an electric field (e.g., by applying a voltage to the transparent coating on the inner surface of the window W of the ionization cell). The position of the laser focus in the ionization cell can be adjusted by moving the microscope objective.

Figure 11:
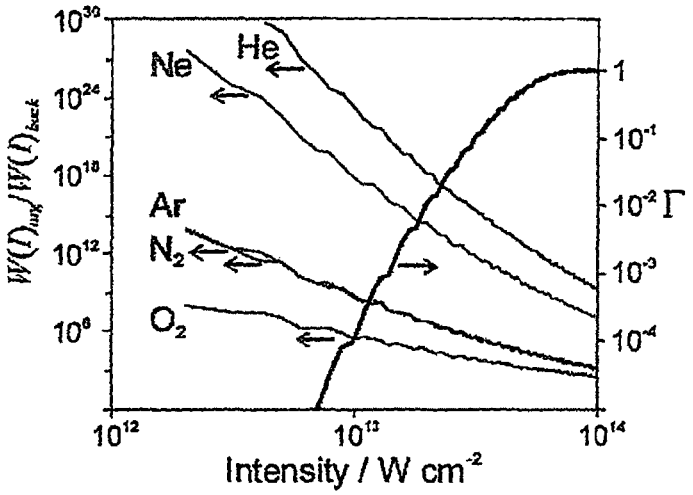
FIG. 11 depicts relative ionization rates of n-propyl benzene, $O_2$, $N_2$, Ar, Ne and He (left ordinate) and the ionization probability of n-propyl benzene, G, for a 50 fs pulse (right ordinate) as function of laser intensity.

The ionization cell IC performs two functions. First, it allows a gas stream to be studied. Second, it allows the use of a carrier gas other than air. With intense field laser ionization at high pressure, the limiting background noise, in the absence of contaminants, is determined by ionization of the carrier or background gas. Multiphoton ionization rates strongly depend on the ionization potential (IP) of the atom or molecule to be ionized. By way of example, FIG. 11 shows estimated intensity dependence of the relative ionization rates $$\frac{W(I)_{org}}{W(I)_{back}}$$

of n-propyl benzene (IP=8.72 eV), taken as a typical organic molecule, compared to $O_2$ (IP=12.1 eV), $N_2$ (IP=15.6 eV), Ar (IP=15.8 eV), Ne (IP=21.6 eV) and He (IP=24.6 eV) as a function of laser intensity. These values are the ratios of probabilities of ionizing organic molecule of interest and a buffer gas (or background) molecule. The rates were obtained from a semi-empirical adaptation of the Perelemov, Popov and Taren'ev (PPT) model (which is described in Soy. Phys. JETP 1966, 23, 924), which is shown to reproduce the ion yields of $O_2$, $N_2$ and Ar over seven orders of magnitude from perturbation to the tunneling limit (See, e.g., Talebpour, A., Yang, J., Chin, S. L. *Optics Communications,* 1999, 163, 29-32). In this approach, a single parameter in the PPT formalism, namely, the effective charge $z_{eff}$, is adjusted to fit the experimental ion yield curves. For n-propyl benzene, $z_{eff}$ was obtained by adjusting it to reproduce the laser ionization threshold intensity measured by Hankin and co-workers (See, Hankin, S. M., Villeneuve, D. M., Corkum, P. B., Rayner, D. M., Phys. Rev. A 2001, 64, 013405/1-12).

$$\frac{W(I)_{org}}{W(I)_{back}}$$

determines the signal-to-background noise, S/B. For example, a value of $10^{10}$ for $$\frac{W(I)_{org}}{W(I)_{back}}$$

would be required to obtain S/B=10 at an analyte concentration of about 1 ppb (parts per billion). Also plotted, FIG. 11 is the ionization probability G of n-propyl benzene as a function of laser intensity, indicating that adequate values of $$\frac{W(I)_{org}}{W(I)_{back}}$$

can be obtained as G approaches unity by using a high IP gas as carrier. From the $N_2$ and $O_2$ curves, it is clear that air or $N_2$ would not be suitable as carrier gases in this case, though in other cases they can be suitable carrier gases. Thus, the pumping system of the QStar XL spectrometer was modified to provide the high compression ratio required to accommodate He as a carrier gas.

Gas mixtures were prepared in a storage bottle attached to a gas manifold. Low analyte concentrations were obtained by successive dilutions of a stock mixture made using a capacitance manometer, which was used to measure the initial partial pressure of the analyte. Flow into the ionization cell is controlled by an in-line regulator followed by a length of flow restricting capillary tubing. The pressure in the cell was measured using a second capacitance manometer.

The source for generating the laser radiation was a Ti:Sapphire laser system operating at a wavelength of 800 nm that produced pulses of 42 fs and longer at energies up to 3 microJoules (μJ) at a repetition rages from single shot to 100 kHz. The laser system includes a passively mode locked femtosecond oscillator (KMlabs), and NRC built grating-based pulse stretcher, a regenerative amplifier (Coherent RegA) and an NRC built grating-based pulse compressor. The pulse duration was controlled between 42 fs and 1.5 ps by applying quadratic chirp through changing the grating mirror separation in the compressor. Pre-chirping was used to compensate for dispersion in the optical path between the laser and the ionization cell. The repetition rate of pulses generated by the laser was controlled through the external triggering of the regenerative amplifier cavity Q-switch. The trigger signal was provided by a master clock, which could be varied between single shot and 100 kHz. The laser beam was spatially filtered at the output of the pulse compressor using a telescope with a pinhole to ensure a high quality Gaussian spatial mode. The pulse energy was adjusted using a half-wave-plate/polarizer combination in the beam that could be adjusted under computer control when performing intensity studies.

In one example, Xe was chosen as the analyte for calibrating the instrument for several reasons: 1) the intense field ionization of Xe has been extensively studied under collision free conditions in high vacuum (Xe ionization rates are well reproduced by PPT theory); 2) as an atom, Xe does not undergo fragmentation when ionized; and 3) Xe has a distinctive natural isotope distribution, which helps in analyzing saturation effect and in addition the low abundance isotopes can be used to establish limits of detection (LOD) without extreme dilution.

Figure 12:
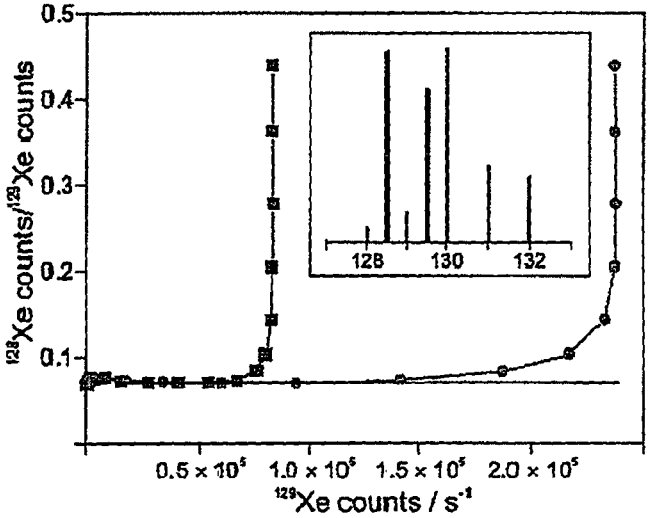
FIG. 12 depicts the ratio of the $^{128}Xe$ and the $^{129}Xe$ peaks in the mass spectrum of natural Xe obtained by the high pressure femtosecond ionization source shown in FIG. 9 as a function of the counts/s in the $^{129}Xe$ peak: (the squares indicate raw data, the circles depict the data with pile-up correction); the horizontal line indicates the natural $^{128}Xe/^{129}Xe$ ratio (the inset shows the isotope abundances of natural Xe)

To determine the dynamic range of the MS system and to establish conditions for reliable quantitative measurements saturation limits need to be understood to distinguish the limits intrinsic to the MS from those imposed by high pressure (e.g., atmospheric pressure) femtosecond laser ionization process. Ion counting systems have pulse-pile up limitations that set a limit on the count rate for individual peaks. FIG. 12 shows the ratio of $^{128}$Xe and $^{129}$Xe peaks as a function of the count/s. The natural $^{128}$Xe/$^{129}$Xe is 0.073, indicated by the horizontal line in the figure. This ratio is found in the raw data at moderate count rates but as the count rate, S, in the $^{129}$Xe peak gets above $0.5\times10^5$ it starts to saturate causing the ratio to climb. The useful single peak range can be extended by applying a correction of the form $S_{corr}=1/(1-\alpha S)$, where α is a correction coefficient that is estimated by comparing saturated and unsaturated peaks and depends on MS settings. The result is shown as the corrected data in FIG. 12. This procedure extends the single peak saturation limit to $1.5\times10^5$. The rest of the results reported herein are pile-up saturation corrected. A second saturation effect intrinsic to the MS involves overloading the data transfer channel from the time-to-digital converter (TDC) to the acquisition computer. For the QStar XL spectrometer, this saturation effect puts a limit of $10^6$ counts/s on the total ion count.

Figures 13A, 13B:
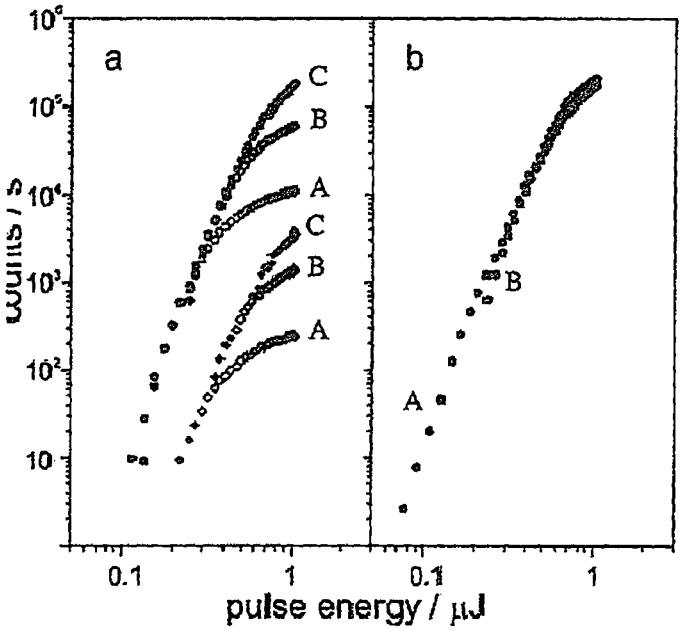
FIG. 13A depicts the effects of concentration and laser repetition rate on the laser pulse energy dependence of Xe ionization by showing normalized yield versus energy curves obtained for 725 (points A), 72.5 (points B), and 7.25 ppm (points C) Xe: the circles plot the total $Xe^+$ yield and the diamonds plot the $^{128}Xe^+$ yield where the laser repetition rate is 20 Hz.
FIG. 13B depicts the effects of concentration and laser repetition rate on the laser pulse energy dependence of Xe ionization by showing normalized yield versus energy curves obtained at 100 kHz, 0.725 ppm Xe (points A) and 20 Hz, 7.25 ppm (points B)

The occurrence of source saturation directly associated with high pressure femtosecond laser ionization is apparent from FIG. 13A. The curves A, B, and C plot the laser pulse energy dependence of the normalized measured Xe ionization signals at different concentrations of Xe. In the absence of source saturation, these curves should be superimposed. They clearly are not, with the higher concentrations showing earlier saturation. The signal for the minor $^{128}$Xe isotope (lower A, B, and C curves) also shows saturation, ruling out pile-up and demonstrating that the saturation is a total ion effect. Because the total un-normalized count rate was kept well below $10^6$ $s^{-1}$ by operating the laser at 20 Hz, it was possible to rule out saturation of the TDC data channel. Without being limited to any particular theory, this source saturation can be attributed to space-charge preventing electrons from escaping the ionization volume so that recombination can occur, thereby reducing the ion yield. Inspection of the curves show that saturation occurs at ~1500 counts/s at the detector under the focal conditions (microscope objective NA=0.25) used for collecting this data with 20 Hz laser repetition rate. Space charge saturation is a per shot rather than a count rate effect. Dividing by the 20 Hz repetition rate, a saturation limit of 75 detected ions per shot is obtained. If the laser is operated at 100 kHz, this implies a space-charge limit of $7.5\times10^6$ counts/s, which is above the MS total count rate capacity. Hence, at this repetition rate, source saturation is not a problem.

FIG. 13B confirms that there is a direct scaling with repetition rate. The absolute count rate for the 100 kHz data was $10^6\ s^{-1}$ at the highest laser pulse energy. The coincidence with the results obtained for low absolute count rate of 20 Hz confirms that source saturation is not interfering at 100 kHz. The 100 kHz results in FIG. 13B were obtained using a concentration of Xe of 0.725 ppm. At this concentration, it was feasible to obtain 1350 counts/s in the $^{124}$Xe mass peak. At natural abundance, $^{124}$Xe is present at 0.09% making its concentration 650 ppt. This sets the limit of detection (LOD) at 1 ppt. At this sensitivity, the upper limit of concentration is 1 ppm, as determined by saturation effects. Higher concentrations can be accommodated at the expense of sensitivity by using lower laser intensities or repetition rates. 1 ppt represents the LOD achieved with the exemplary high pressure femtosecond laser ionization source in its current configuration.

The Xe+ yield was modeled using intense field ionization theory to provide guidance to understand how high pressure femtosecond laser ionization depends on laser pulse parameters and focusing conditions. It was confirmed that 100% efficient ionization was achieved at the focus and it was possible to obtain a measurement of the ion collection efficiency of the mass spectrometer.

Figure 14:
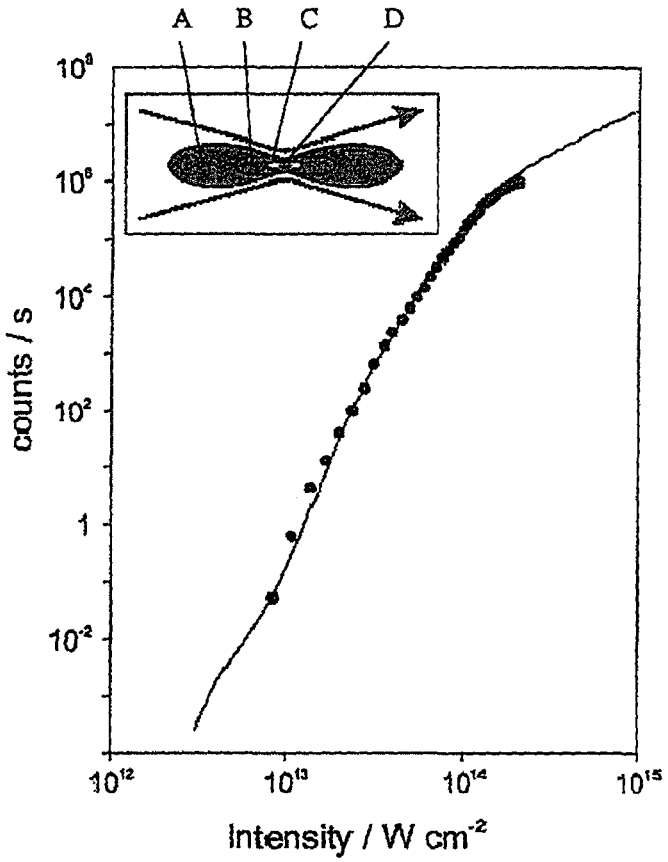
FIG. 14 depicts comparison of the measured Xe ion yield (circles) with the yield calculated using intense field ionization theory (solid line) (the inset depicts a section through a Gaussian laser focus showing the volumes where the intensity is above 0.01 (A), 0.05 (B), 0.3 (C), and 0.8 (D) times the maximum intensity)

FIG. 14 shows the Xe ion signal as a function of laser intensity, measured under conditions where the saturation effects discussed above are insignificant (0.725 ppm Xe, 100 kHz). Qualitatively, the shape of the curve can be understood knowing that the non-resonant multiphoton ionization rate is highly non-linear with laser intensity and that the intensity I varies over the laser focus, as depicted in the figure inset, according to the following relation:

$$I = \frac{I_0}{1 + z^2/z_0^2}\exp\left(\frac{2r^2}{\omega_0^2(1 + z^2/z_0^2)}\right) \tag{1}$$

where $I_0$ denotes the peak intensity, r is the radial distance from the center axis of the beam and z is the axial distance from the beam waist. $\omega_0$ is the radius at the beam waist and $z_0=\pi\omega_0^2/\lambda$, where $\lambda$ denotes the laser wavelength. At low intensities, the ion yield rises rapidly with intensity reflecting the high order intensity dependence of the ionization process. At some point the intensity is high enough so that the ionization probability at the beam waist effectively reaches 1. This is the saturation intensity $I_{sat}$. Although ionization at the waist is now saturated, the ion signal continues to grow as the volume in which $I>I_{sat}$ grows as $I_o$ increases above $I_{sat}$, eventually reaching a regime where it becomes proportional to $I^{1.5}$, reflecting the conical geometry of the beam away from the focus. The curve in FIG. 14 fits this expectation.

To model the ion signal S, integration over the focal volume in space and over the laser pulse duration is required. For a Gaussian beam, the integration over space can be transformed into an integration over intensity, thus leading to the following relation:

$$S = \alpha f V_0 c \int_0^{I_0} \left(1 - e^{-\int_{-\infty}^{\infty} W(If*(t))dt}\right)\frac{\sqrt{\frac{I_0}{I} - 1}}{3I}\left(\frac{I_0}{2I} + 1\right)dI \tag{2}$$

where $\alpha$ denotes the ion collection efficiency of the mass spectrometer, f is the laser repetition rate, c is the concentration of analyte and $V_0=2(\pi\omega_0^2)^2/\lambda$, is the focal volume. (W(If(t)) is the ionization rate at intensity If(t) wherein f(t) is the temporal pulse profile. For a square pulse of duration $\tau$ the integral $\int_{-\infty}^{\infty}W(If(t))dt$ reduces to $W(I)\tau$.

The solid line in FIG. 14 is obtained by solving Eq. (2) numerically with a Gaussian temporal profile with $f(t)=\exp(-\sigma^2/\tau^2)$ where $\tau$ is now the pulse half-width at 1/e. Ionization rates were obtained using PPT theory. As mentioned above, PPT theory is known to reproduce Xe ionization rates from the perturbative regime at low intensities ($W(I)\propto I^k$, where k is the multiphoton order) to the tunneling regime at high intensities ($W(I)\propto\exp(-2(2IP)^{3/2}/3E$, where E is the electric field of the laser). In fitting the curve to the experimental result, the mass spectrometer ion collection efficiency $\alpha$, and the beam radius $\omega_0$ were used as fitting parameters. $\alpha$ is unknown and $\omega_0$ is hard to measure for a focal spot of the order of a micron. A low limit for $\omega_0$ can be estimated from the objective NA but this assumes the optical system is aberration free and that the spatial mode of the beam is pure. In practice, this can be hard to achieve. In intense field studies in high vacuum, it is common to use Xe ionization yields to establish the intensity at a laser focus. Although two fitting parameters were used, they were not highly sensitive to each other. The parameter $\alpha$ scales the signal vertically while $\omega_0$ influences the shape of the curve and the effective value of $I_{sat}$. The fit was obtained with $\omega_0$=2.2 μm. The value of $\omega_0$ is not unreasonably higher than the theoretical diffraction limited value of $\omega_0$, namely, 1 micron.

The model shows that high pressure ionization yields can be understood using theory developed for isolated atoms. 100% ionization efficiency is achievable and the resulting ions can be effectively monitored using conventional mass spectroscopy techniques.

Ionization of Organics

Figure 15:
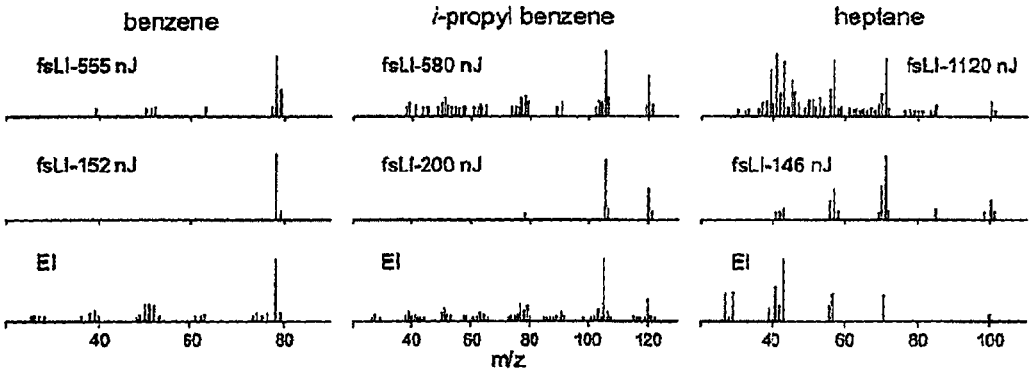
FIG. 15 depicts mass spectra of benzene, iso-propyl benzene and heptane obtained by the high pressure femtosecond ionization source shown in FIG. 9 at laser pulse energies indicated in each panel. Standard Electron Impact (EI) spectra are shown in the lower panels. The laser was focused with a 0.1 NA microscope objective and the pulse length was 43 fs (FWHM). Under these conditions, 120 nJ corresponds to a peak intensity (power density) of $10^{13}$ W/cm$^2$. In the benzene spectrum, at high intensity, the m/z=78 peak is saturated to make the small degree of fragmentation more visible.

FIG. 15 shows mass spectra of benzene, iso-propyl benzene and heptane obtained by using the above-described modified spectrometer. These compounds were chosen because they are representative of three classes of compounds that are known to show different fragmentation behavior under fs laser ionization at low pressure and because they are sufficiently volatile to make up known dilutions easily. The spectra were obtained from samples diluted in He at 30 to 80 ppb.

Figure 16:
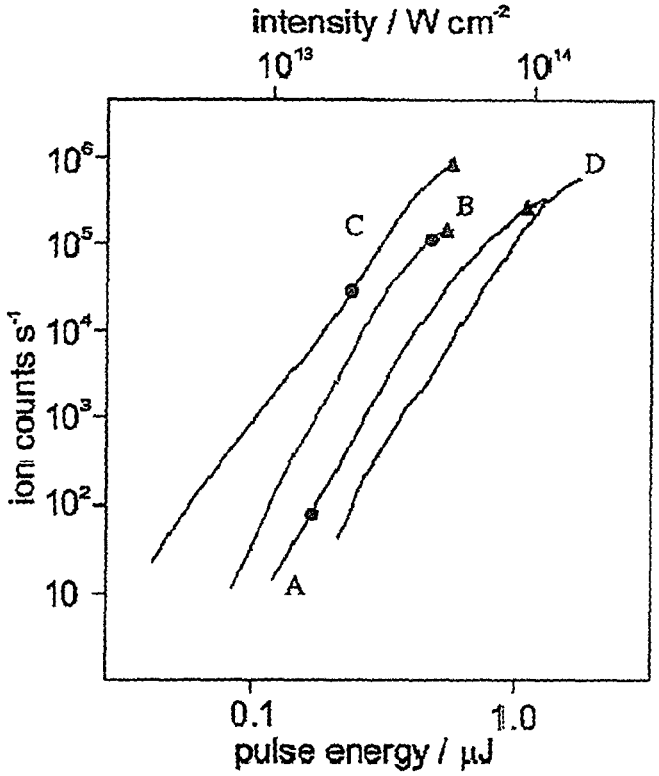
FIG. 16 depicts the laser pulse energy dependence of the total ion yield obtained in the high pressure femtosecond laser ionization of heptane (curve A), benzene (curve B), iso-propyl benzene (curve C) and Xe (curve D) according to an embodiment of the invention. The curves were normalized to a concentration of 42 ppb and were obtained with a 0.1 NA objective, a pulsewidth of 43 fs (FWHM) and a repetition rate of 100 kHz. The estimated peak laser intensity is given on the upper abscissa. The pulse energies at which the high and low energy mass spectra were obtained are indicated by triangle and circle symbols, respectively.

FIG. 16 shows the dependence of the ion yield of the organics on laser pulse energy and estimated intensity. The energy dependence of the ionization of all three molecules is very similar to that of Xe except that the curves are shifted to lower intensities. The extent of the shift is consistent with the IPs that are 9.93, 9.24 and 8.73 eV for heptanes, benzene and iso-propyl benzene, respectively. The plot demonstrates that the teachings of the invention can be employed to ionize at least modest-sized organics with the same efficiency as that observed for Xe.

The pulse energies at which the spectra in FIG. 15 were obtained are marked on the plot to allow correlation of the fragmentation patterns with the ionization efficiency. At a sufficiently low intensity, all three compounds show significantly reduced fragmentation compared to the EI spectra. For aromatics, as exemplified by benzene, the resistance to fragmentation is retained at high energies up to the saturation energy. The 555 nJ spectrum shows a small degree of fragmentation that is exaggerated due to saturation of the parent peak at m/z=78.

In contrast, heptane shows extensive fragmentation close to the saturation intensity that is similar to the EI pattern. Relatively low intensities where the ion yield is of the order of $10^{-3}$-$10^{-4}$ is needed to observe less fragmentation than in EI.

Iso-Propyl benzene is an intermediate case. It shows a single dominant fragmentation channel ($CH_3$ loss) at low laser intensity that persists until the ionization yield reaches 10% of saturation. Above this, the pattern is very similar to the EI spectrum.

In obtaining the spectra shown in FIG. 15, care was taken to reduce interference from chemical ionization (CI) processes. However, residual effects of CI are apparent in the heptane results. CI can be distinguished by moving the laser focus back from the MS aperture giving more time for ion-molecule reactions to take place and by varying the concentration of analyte. By this means, one can identify that the peaks at $M+H^+$ and $M-H^+$ in the heptane spectra are largely due to this process. The proton donor can be the analyte ion itself, or a fragment or species produced by the ionization of impurities such as water. While CI needs to be avoided to study direct laser ionization, it also presents an opportunity for a fs laser driven approach to CI, where the laser is used to deliberately create the proton donor. The deliberate addition of water will lead to the production of $H_30+$ and higher hydronium clusters (depending on the $H_20$ partial pressure). Further, the addition of dry $H_2$ at an appropriate pressure to avoid excessive $(H_2)_nH^+$ clustering can lead to $H^+$. The proton itself can be regarded as the ultimate proton donor.

Optimization

The laser intensity is determined by the pulse energy, the pulse width and the focusing conditions. Consideration of Eq. (2), where the ion signal depends on $V_0$, suggests that the laser should be focused to the largest possible waist size ($V_0=2(\pi\omega_0^2)^2/\lambda$) consistent with achieving an intensity $I_{sat}$, where the ionization probability nears unity. Keeping the intensity below the Coulomb explosion (CE) limit, $I_{CE}$, would also lead one to restrict $I_0$ and maximize $V_0$. In intense field ionization $I_{CE}$ is the limit where the sudden removal of several electrons from a molecule results in drastic fragmentation driven by Coulomb repulsion. For organic molecules $I_{CE}$ is 2 to 3 times $I_{sat}$, implying that $I_0$ needs to be carefully controlled and perhaps adjusted for different molecules according to their $I_{sat}$.

One has to consider that the focused laser beam exposes molecules to intensities below $I_o$ at some point in space. To follow the consequences of such exposure, one can consider a simple threshold model for ionization in which the ionization rate is zero below a threshold $I_{th}$ and infinite above it. Eq. (2) then simplifies to the following relation:

$$S = \propto fV_0\left(\frac{\gamma^3}{3} + 2\gamma - 2\arctan(\gamma)\right) = \alpha fV_x \tag{3}$$

With $\gamma=(I_0/I_{th}-1)^{1/2}$. $V_x$ is the volume in which $I>I_{th}$. FIG. 17 shows how $V_x$ varies with $\omega_0$ at fixed pulse energy, $E_0$, and $I_{th}$. The solid curve is from Eq. (3) and the symbols are from a numerical solution of Eq. (2) using W(I) values calculated for Xe using PPT theory. $I_{th}$ in the threshold model has been adjusted to $8.3\times10^{13}$ to fit the numerical prediction. The disagreement at large $\omega_0$ (low intensity) is an expected deficiency of the threshold model. However, the agreement is reasonable where $V_x$ reaches its maximum. It can be shown using the threshold model that the maximum occurs at the beam waist given by the following relation:

$$\omega_{max} = \sqrt{\frac{0.73E_0}{I_{th}\pi^{3/2\tau}}} \tag{4}$$

This expression can be used to estimate the optimum focusing conditions from the laser parameters $E_0$ and $\tau$ and the threshold intensity $I_{th}$. At least for modest-sized organic molecules, with IPs in the range of 8 to 10 eV, one can expect $I_{th}$ to be of the order of 40 to 80 TW/cm$^2$. The required power of the focusing lens is available from standard lens formula once the target $\omega_{max}$ is established.

The threshold model can also be used to investigate the effect of increasing $E_0$ in the presence of fragmentation. If undesirable fragmentation occurs at intensities above a threshold $I_F$ while useful ionization occurs above a lower threshold, $I_I$, one can use Eq. (3) to establish a volume ($V_M$) that contains useful ions as the difference between the volume above the ionization limit, $V_I$, and the volume over the fragmentation limit, $V_F$. FIG. 17B shows an example of the dependence of the ratio of undesirable fragment ions to useful ions as a function of $I_0$. Above the fragmentation threshold, the fraction of fragment ions rises but it reaches a limiting value so that fragmentation cannot dominate unless $I_F$ is very close to $I_M$. Inspection of Eq. (3) in the limit of $I_0>>I_x$, where $\gamma\rightarrow(I_0/I_x)^{3/2}$, shows that this is expected, with $S_F/S_M\rightarrow1/((I_F/I_I)^{3/2}-1)$. The curve in FIG. 10B was obtained with $I_F=2I_I$, the lower range of the difference between ionization and Coulomb explosion thresholds. At intensities well above $I_{CE}$, there are not less than twice the number of unexploded ions as CE fragments. As the small mass and multiply charged CE fragments can be discriminated against in the Qstar mass spectrometer, it is reassuring to know that one can operate well above $I_{CE}$ and still expect to observe substantial signal from molecular ions. This feature can be particularly useful for studying compounds whose femtosecond laser ionization has not been previously characterized.

Figure 17A:
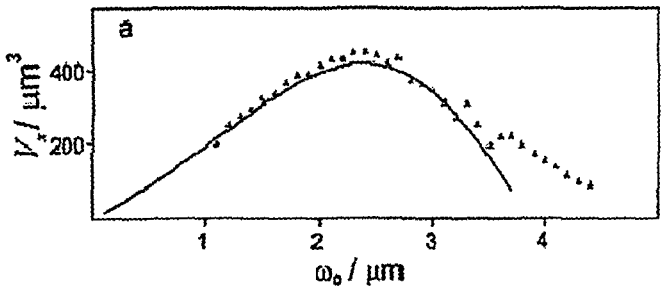
FIG. 17A shows the dependence of the effective ionization volume, $V_x$, on the beam waist radius, $\omega_0$, obtained under the assumption of constant laser energy from the threshold model, Eq. (3) (solid curve) and by numerical integration of Eq. (2) (points)
Figure 17B:
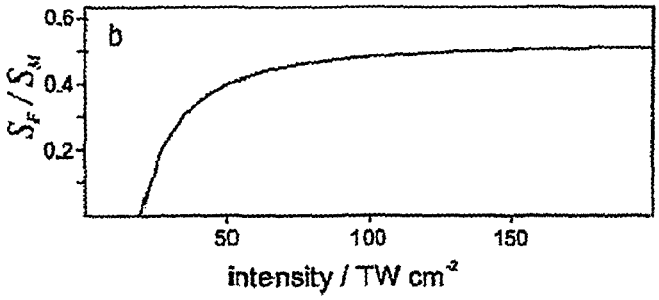
FIG. 17B shows the dependence of the ratio of the signal due to fragment ions to the signal due to molecule ions ($S_F/S_M$) on laser peak intensity under the threshold model for an ionization threshold of 10 TW/cm$^2$ and a fragmentation threshold of 20 TW/cm$^2$.

FIG. 17A shows the dependence of the effective ionization volume, $V_x$, on the beam waist radius, $\omega_0$, obtained from the threshold model, Eq. (3) (solid curve) and by numerical integration of Eq. (2) (points). FIG. 17B shows the dependence of the ratio of the signal due to fragment ions to the signal due to molecule ions ($S_F/S_M$) on laser peak intensity under the threshold model for an ionization threshold of 10 TW/cm$^2$ and a fragmentation threshold of 20 TW/cm$^2$.

Figure 18:
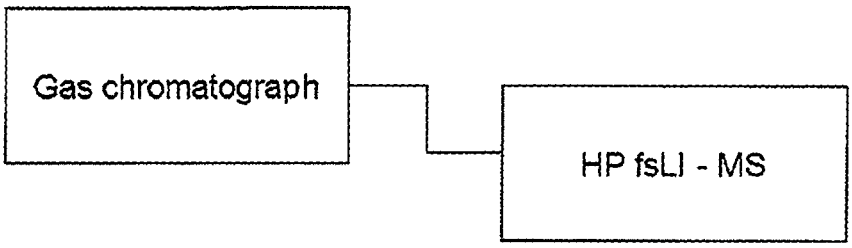
FIG. 18 shows one exemplary embodiment of a GC-MS system according to the applicant's teachings.

As noted above, the sample can be provided to the ionization chamber by a variety of mechanisms. FIG. 18 shows one exemplary embodiment of a GC-MS system. In use, a sample (e.g., a mixture of compounds) can be injected into GC, e.g., all at once. Due to GC separation, each component can elute into the high pressure femtosecond laser ionization mass spectrometer (HP fsLI MS) at a different time, such that components can be analyzed sequentially by the HP fsLI MS.

Figure 19:
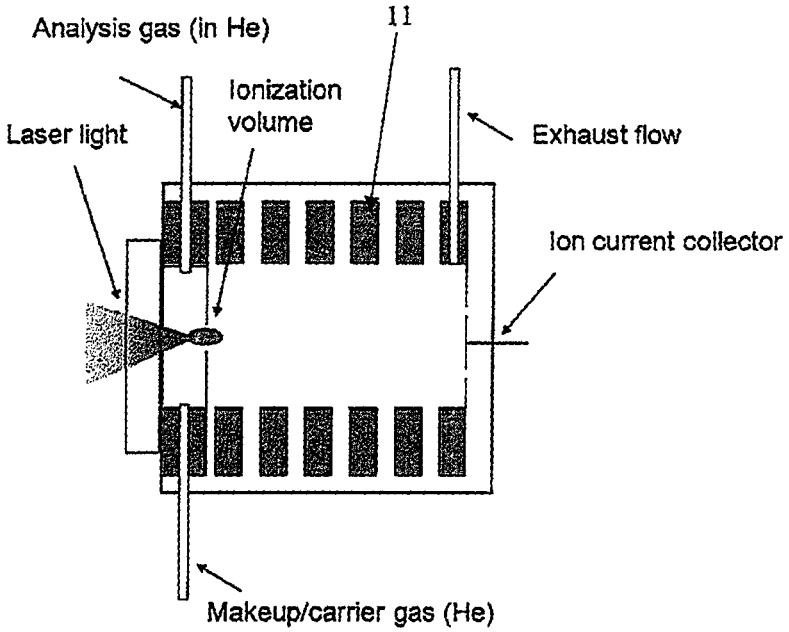
FIG. 19 shows one exemplary embodiment of a standalone high pressure femtosecond laser ionization (HP-fsLI) ion mobility system according to the applicant's teachings.

FIG. 19 shows one exemplary embodiment of a standalone high pressure femtosecond laser ionization (HP-fsLI) ion mobility system. In use, ions can be produced by one or more laser pulses. Thereafter, the ions can enter an ion mobility cell 11 with an axial field. The ions can then be separated by their individual drift velocities in the ion mobility cell 11. Small ionization volume in fsLI can be ideally suited for ion mobility measurements. Initial coordinates of the ions can be tightly confined and their appearance time is well defined in fsLI. This can simplify the coupling of HP-fsLI with ion mobility spectrometers.

Figure 20:
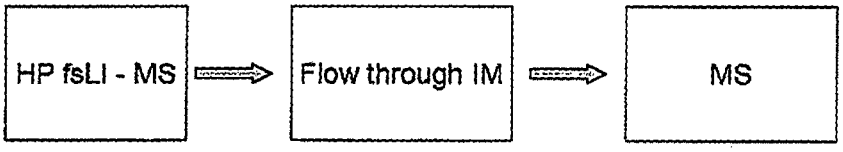
FIG. 20 shows one exemplary embodiment of a system in which high pressure femtosecond laser ionization (HP fsLI) is used with ion mobility (IM)-mass spectrometry (MS) according to the applicant's teachings.

FIG. 20 shows one exemplary embodiment of a system in which high pressure femtosecond laser ionization (HP fsLI) is used with ion mobility (IM)-mass spectrometry (MS) system. In some embodiments, HP fsLI can be compatible with flow-through ion mobility cells (e.g., of a differential mobility spectrometer (DMS) or a differential mobility analyzer (DMA)) due to the small size of the ionization region. Other combinations of MS and IM are possible, such as MS-IM-MS.

While the present invention has been described in terms of specific methods, structures, devices, and formulations, it is understood that variations and modifications will occur to those skilled in the art upon consideration of the present invention. Further, the features illustrated or described in connection with one embodiment can be combined with the features of other embodiments. Such modifications and variations are intended to be included within the scope of the present invention. Those skilled in the art will appreciate, or be able to ascertain using no more than routine experimentation, further features and advantages of the invention based on the above-described embodiments. Accordingly, the invention is not to be limited by what has been particularly shown and described.

All publications and references are herein expressly incorporated by reference in their entirety. The terms "a" and "an" can be used interchangeably, and are equivalent to the phrase "one or more" as utilized in the present application. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

What is claimed is:

1. In a mass spectrometer, a method for ionizing a sample, comprising:

irradiating a sample at an ambient pressure in a range of about $10^{-5}$ Torr to about $10^{5}$ Torr with one or more radiation pulses having a pulsewidth in a range of about 2 fs to about 1 ps at a pulse power density in a range of about 1 $TW/cm^2$ to about 1000 $TW/cm^2$ to cause ionization of at least a portion of the sample.

2. The method of claim 1, wherein said radiation pulses have a pulsewidth in a range of about 30 fs to about 500 fs.

3. The method of claim 1, wherein said radiation pulses have a pulsewidth in a range of about 50 fs to about 100 fs.

4. The method of claim 1, further comprising introducing the sample into an ionization chamber and focusing said radiation pulses onto a focal volume in said chamber to cause said ionization of the sample.

5. The method of claim 4, further comprising flowing a carrier gas into said ionization chamber to generate a flow of the sample through the chamber and optionally, wherein said sample is in a gaseous state and further comprising flowing said gaseous sample into the ionization chamber and wherein the carrier gas optionally comprises a noble gas.

6. The method of claim 1, wherein said radiation pulses cause non-resonant ionization of one or more constituents of said sample.

7. The method of claim 1, wherein said radiation pulses have a central wavelength in a range of about 200 nm to about 100 microns.

8. The method of claim 1, wherein said radiation pulses have a central wavelength in a range of about 600 nm to about 10 microns.

9. The method of claim 1, wherein said radiation pulses have a central wavelength in a range of about 800 nm to about 3 microns.

10. The method of claim 1, wherein said radiation pulses are applied to the sample at a repetition rate in a range of about 1 Hz to about 100 MHz and optionally, wherein said radiation pulses comprise laser pulses.

11. The method of claim 1, wherein said ambient pressure is in a range of about 1 Torr to about 10000 Torr.

12. The method of claim 1, further comprising introducing said ionized sample into a mass analyzer.

13. The method of claim 1, wherein said laser pulses have a pulsewidth less than one picoseconds.

14. The method of claim 1, wherein said ambient pressure is in a range of about 1000 Torr to about $10^{5}$ Torr.

15. In a mass spectrometer, a method of ionizing an analyte, comprising:

irradiating a chemical ionization reagent at an ambient pressure in a range of about $10^{-5}$ Torr to about $10^{5}$ Torr with one or more laser pulses having a pulsewidth in a range of about 2 fs to about 1 ps so as to cause ionization of the chemical ionization reagent, and causing said ionized chemical ionization agent to interact with said analyte to cause ionization of the analyte via ion-molecule reactions and optionally, wherein said chemical ionization reagent comprises any of Hydrogen ($H_2$), Deuterium ($D_2$), water ($H_2O$), Nitrogen ($N_2$), Oxygen ($O_2$), Methane ($CH_4$), and benzene ($C_6H_6$).

16. The method of claim 15, wherein said laser pulses cause non-resonant ionization of said chemical ionization reagent.

17. A ionization system for use in mass spectrometry, comprising:

a laser configured to provide laser pulses having a pulsewidth in a range of about 2 fs to about 1 ps, an ionization chamber having an optical window transmissive to said laser pulses to allow the passage of the pulses into an interior volume thereof, said chamber being configured to receive an analyte and being configured for fluid communication with a mass analyzer, an optical system for focusing said laser pulses into a focal volume within said ionization chamber so as to generate a radiation intensity in a range of about 1 $TW/cm^2$ to about 1000 $TW/cm^2$ in said focal volume, thereby ionizing at least of a portion said analyte in said focal volume, wherein a pressure within said chamber is in a range of about $10^{-5}$ Torr about $10^{5}$ Torr.

18. The system of claim 17, further comprising a fluid channel coupled to said chamber for delivering said analyte to the chamber.

19. The system of claim 18, further comprising a electrically conductive coating disposed on an inner surface of said optical window.

20. The system of claim 19, further comprising a voltage source configured to apply a voltage to said electrically conductive coating.

* * * * *